US006880473B2

(12) United States Patent
Fukao

(10) Patent No.: US 6,880,473 B2
(45) Date of Patent: Apr. 19, 2005

(54) THREAD HOLDING MECHANISM AND SEWING MACHINE PROVIDED THEREWITH

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 77 days.

(21) Appl. No.: 10/631,715

(22) Filed: Aug. 1, 2003

(65) Prior Publication Data

US 2004/0089210 A1 May 13, 2004

(30) Foreign Application Priority Data

Aug. 1, 2002 (JP) ..... 2002-225247

(51) Int. Cl.[7] ..... G05B 87/02
(52) U.S. Cl. ..... 112/225
(58) Field of Search ..... 112/225, 302, 112/253, 242; 223/99

(56) References Cited

U.S. PATENT DOCUMENTS 2,707,448 A * 5/1955 Reinhold ..... 112/225
4,651,660 A * 3/1987 Oshima et al. ..... 112/225
5,003,900 A * 4/1991 Ogawa ..... 112/242
6,067,919 A * 5/2000 Shoji ..... 112/225
6,761,121 B1 * 7/2004 Kotaki ..... 112/225
6,814,016 B1 * 11/2004 Hori ..... 112/225

* cited by examiner

*Primary Examiner*—Ismael Izaguirre
(74) *Attorney, Agent, or Firm*—Oliff & Berridge, PLC

(57) ABSTRACT

A thread holding mechanism for sewing machines is disclosed holding a thread when the thread is passed through an eye of a sewing needle. The mechanism includes a thread holding member including a thread holding portion capable of holding the thread, an operating force transmitting member to which an external force is applied, a moving member to which the operating force transmitting member transmits the force, moving the thread holding member near the eye of the needle, and a thread nipping member provided in the thread holding member for releasably nipping the thread, a switching member provided near a movement path of the thread holding member for switching the thread nipping member to an interposition releasing side temporarily prior to thread holding in synchronization with a predetermined stage of a step of moving the thread holding member.

6 Claims, 31 Drawing Sheets

THREAD HOLDING MECHANISM AND SEWING MACHINE PROVIDED THEREWITH

BACKGROUND OF THE INVENTION

1. Field of the Invention

This invention relates to a thread holding mechanism for holding a thread for the purpose of passing the thread through an eye of a needle and a sewing machine provided with the thread holding mechanism.

2. Description of the Related Art

Conventional sewing machines have been provided with a cassette mount to which a thread cassette accommodating a supply of thread such as a thread spool is detachably attached and a threading mechanism capable of passing a thread through an eye of a needle in synchronization with attachment of the thread cassette to the cassette mount. For example, JP-A-2002-191886 filed by the assignee of the present application discloses such a sewing machine.

The above-noted threading mechanism comprises a threading shaft adjacent to a needle bar and a threading hook coupled to a lower end of the threading shaft. When the thread cassette is attached to the cassette mount provided on a sewing machine head, the threading shaft is rotated in synchronization with attachment of the thread cassette.

In the aforesaid construction, the threading hook is passed through the needle eye upon rotation of the threading shaft, and the thread is caught on the threading hook. The threading hook is then pulled through the needle eye, whereby the thread is passed through the needle eye.

However, a worker needs to thread a support plate of the threading mechanism, thread guide discs, etc. with the needle thread drawn from the thread cassette when the thread cassette is attached to the cassette mount. This work is troublesome and reduces a working efficiency.

SUMMARY OF THE INVENTION

Therefore, an object of the present invention is to provide a thread holding mechanism which can automatically hold the thread near the needle eye reliably and enhance passing the thread through the needle eye in synchronization with attachment of the thread cassette to the cassette mount, and a sewing machine provided with such thread holding mechanism.

The present invention provides a thread holding mechanism holding a thread when the thread is passed through an eye of a sewing needle. The mechanism comprises a thread holding member including a thread holding portion capable of holding the thread, an operating force transmitting member to which an external force is applied, a moving member to which the operating force transmitting member transmits the force, moving the thread holding member near the eye of the needle, and a thread nipping member provided in the thread holding member for releasably nipping the thread, a switching member provided near a movement path of the thread holding member for switching the thread nipping member to an interposition releasing side temporarily prior to thread holding in synchronization with a predetermined stage of a step of moving the thread holding member.

When the operating force is transmitted from the operating force transmitting member to the moving member, the moving member moves the thread holding portion of the thread holding member near the needle eye. In synchronization with the predetermined stage of the thread holding member moving step, the thread nipping member is switched to the interposition releasing side temporarily prior to thread holding. As a result, the thread enters a space between the thread holding portion and the thread nipping member. In this state, when the thread nipping member is moved to a position where the thread nipping member is not operated by the switching member, the thread nipping member is re-switched to the nipping side such that the thread is nipped between the thread holding member and the thread nipping member. The thread holding member is moved near the needle eye by the moving member while the thread is nipped between the thread holding member and the thread nipping member. Consequently, the thread can reliably be held near the needle eye.

The invention also provides a sewing machine comprising a thread cassette accommodating a supply of thread and detachably attached to a cassette mount, a threading mechanism passing the thread drawn from the thread supply out of the thread cassette through an eye of a needle in synchronization with attachment of the thread cassette to the cassette mount, and a thread holding mechanism for holding the thread near the needle eye in order that the thread may be passed through the needle eye. The thread holding mechanism includes a thread holding member including a thread holding portion capable of holding the thread, an operating force transmitting member to which an external force is applied, a moving member to which the operating force transmitting member transmits the force, moving the thread holding member near the eye of the needle, and a thread nipping member provided in the thread holding member for releasably nipping the thread, and a switching member provided near a movement path of the thread nipping member for switching the thread nipping member to an interposition releasing side temporarily prior to thread holding in synchronization with a predetermined stage of a step of moving the thread holding member.

In attachment of the thread cassette, the thread holding member including the thread holding portion is moved near the needle eye by the sequential moving mechanism in synchronization with the attachment of the thread cassette. During the movement, the thread nipping member, releasably nipping the thread by the thread nipping portion, is temporarily switched to the releasing side prior to thread interposition in synchronization with the predetermined stage of the thread holding member moving step. At this time, the thread enters the space between the thread holding portion and the thread nipping member. In this state, when the holding member is moved to a position where the thread nipping member is not operated by the switching member, the thread nipping member is re-switched to the nipping side such that the thread is nipped between the thread holding portion and the thread nipping member. The thread holding member is moved near the needle eye by the sequential moving mechanism while the thread is interposed between the thread holding member and the thread nipping member. Consequently, the thread can reliably be held near the needle eye, and the thread can be passed through the needle eye by the threading mechanism operated in synchronization with attachment of the thread cassette.

BRIEF DESCRIPTION OF THE DRAWINGS

Other objects, features and advantages of the present invention will become clear upon reviewing the following description of embodiment, made with reference to the accompanying drawings, in which.

DETAILED DESCRIPTION OF THE INVENTION

One embodiment of the present invention will be described with reference to the accompanying drawings. In the embodiment, the invention is applied to a household sewing machine in which a thread is automatically passed through a needle eye in synchronization with attachment of a thread cassette.

Figure 1:
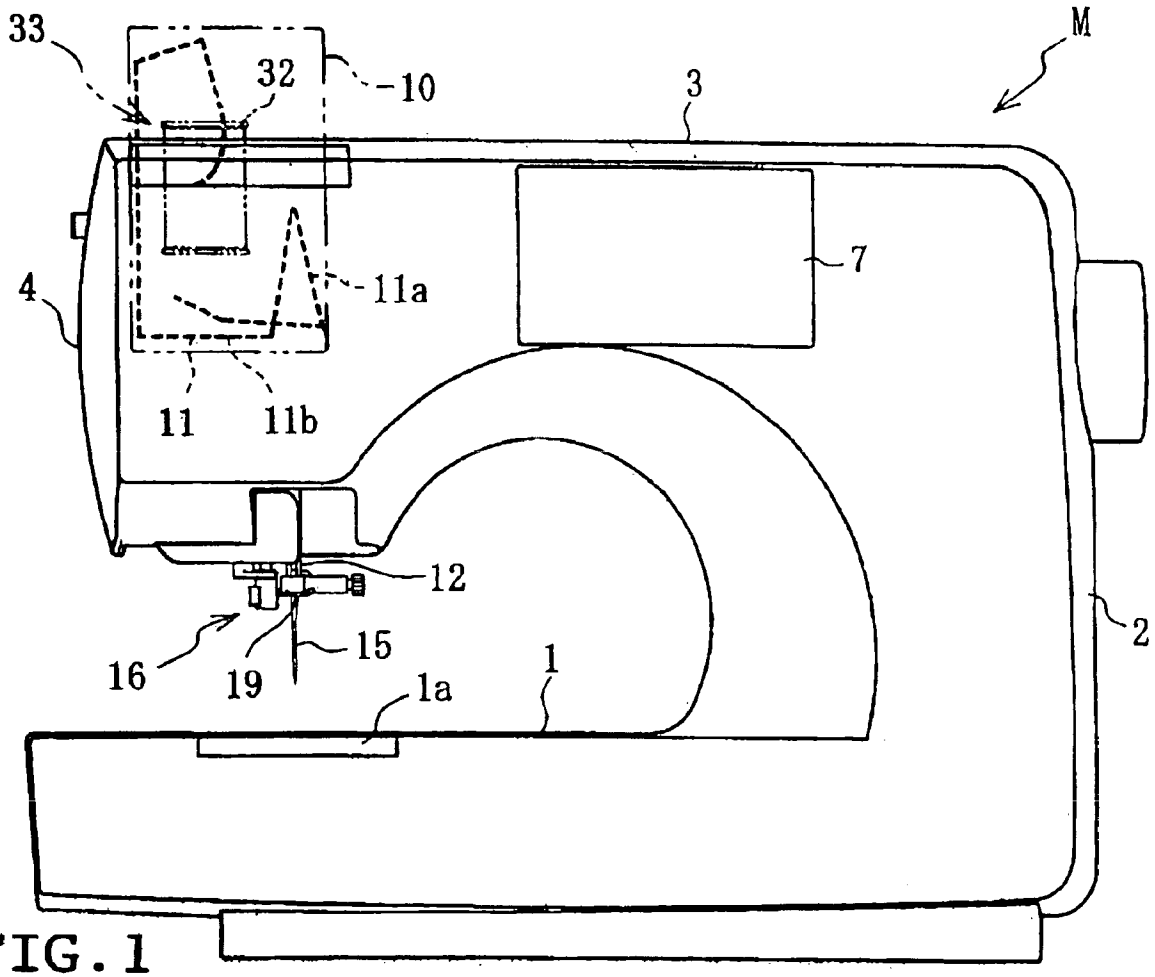
FIG. 1 is a front view of a sewing machine in accordance with one embodiment of the present invention.
Figure 2:
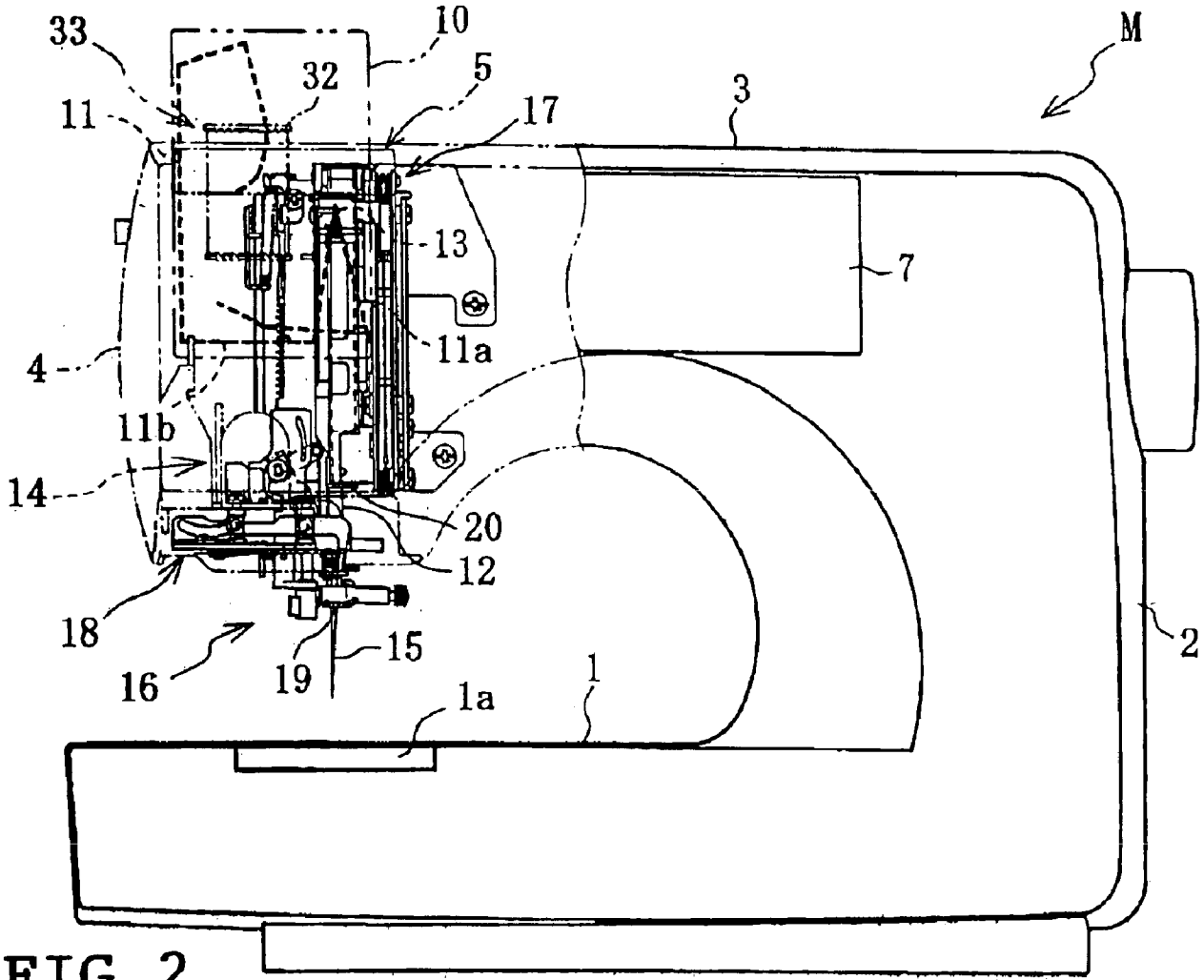
FIG. 2 is a partially cut-out front view of the sewing machine.

Referring to FIGS. 1 and 2, the household sewing machine M includes a sewing bed 1 having a horizontal plane, a pillar 2 standing from a right end of the bed 1, a sewing arm 3 extending leftward from an upper end of the pillar 2 so as to be opposed along the bed 1, and a machine head 4 located at a left end of the arm 3. The head 4 is provided with a cassette mount 5 to which a thread cassette 10 is detachably attached. A thread drawn from the thread cassette 10 attached to the cassette mount 5 serves as a needle thread. The arm 3 or the head 4 thereof includes operation switches (not shown) such as a sewing start switch, sewing finish switch, etc. The arm 3 further includes a liquid crystal display 7.

Figure 3:
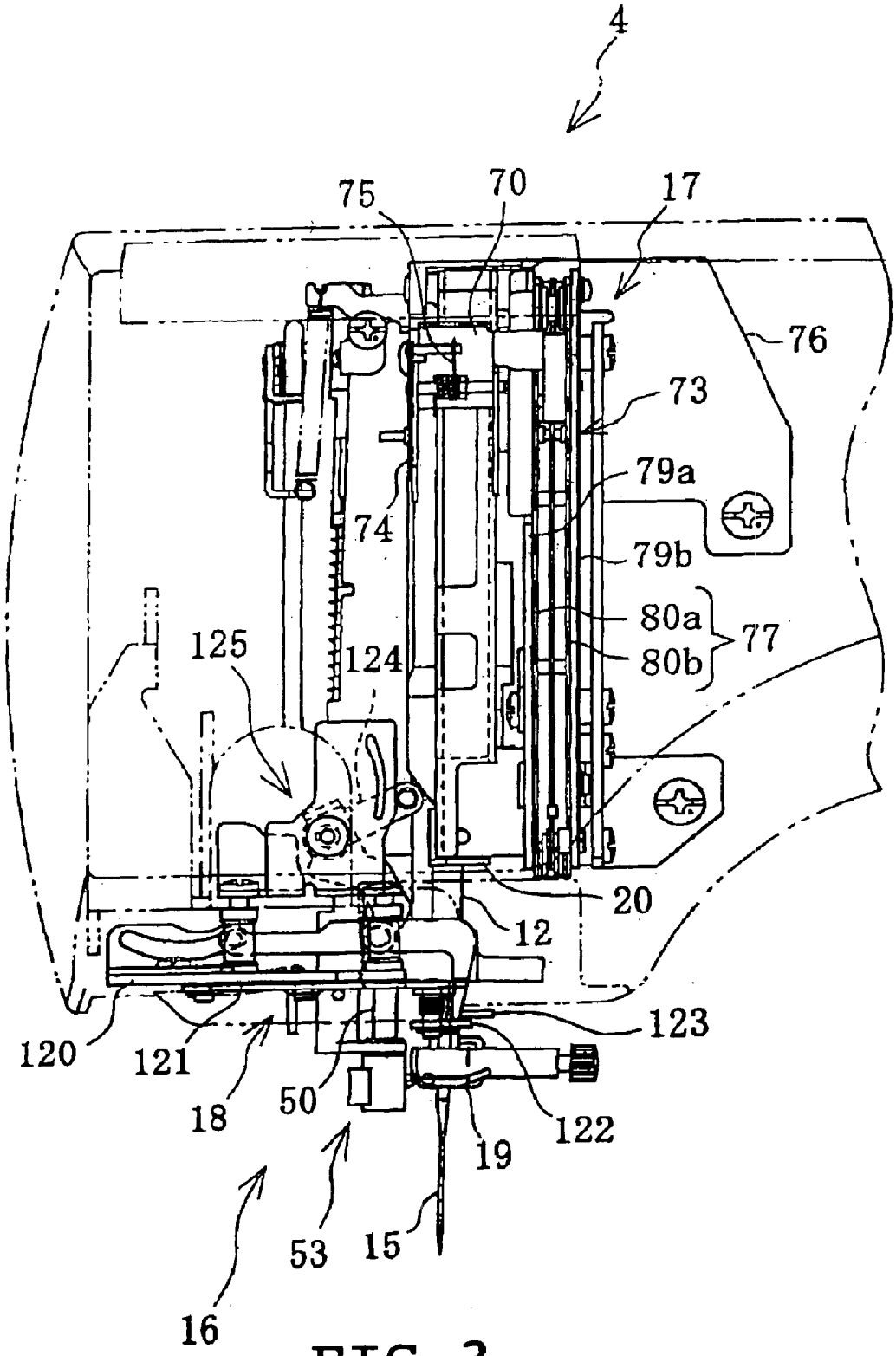
FIG. 3 is a partial enlarged view of the thread holding mechanism.
Figure 4:
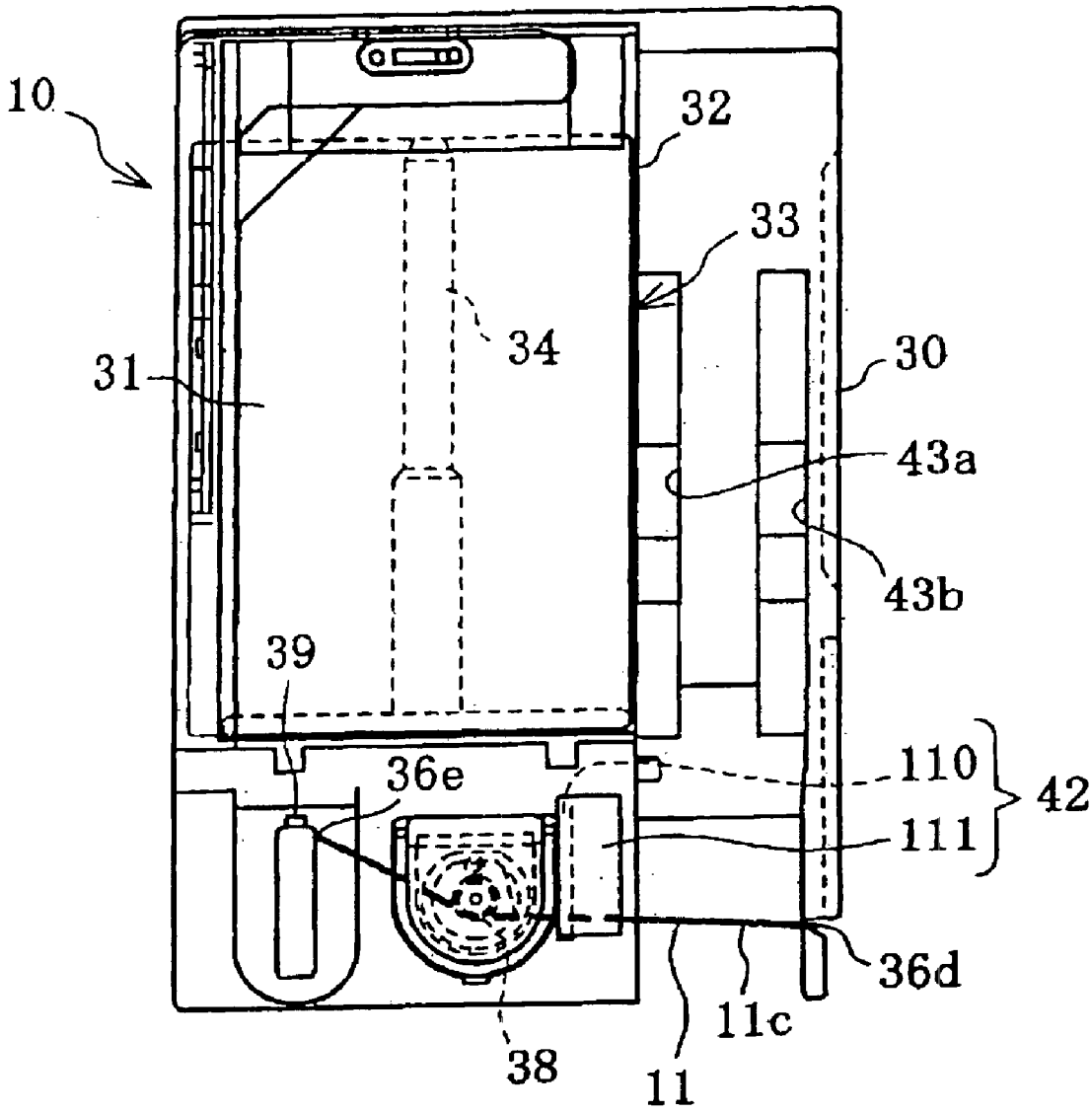
FIG. 4 is a front view of a thread cassette.
Figure 10:
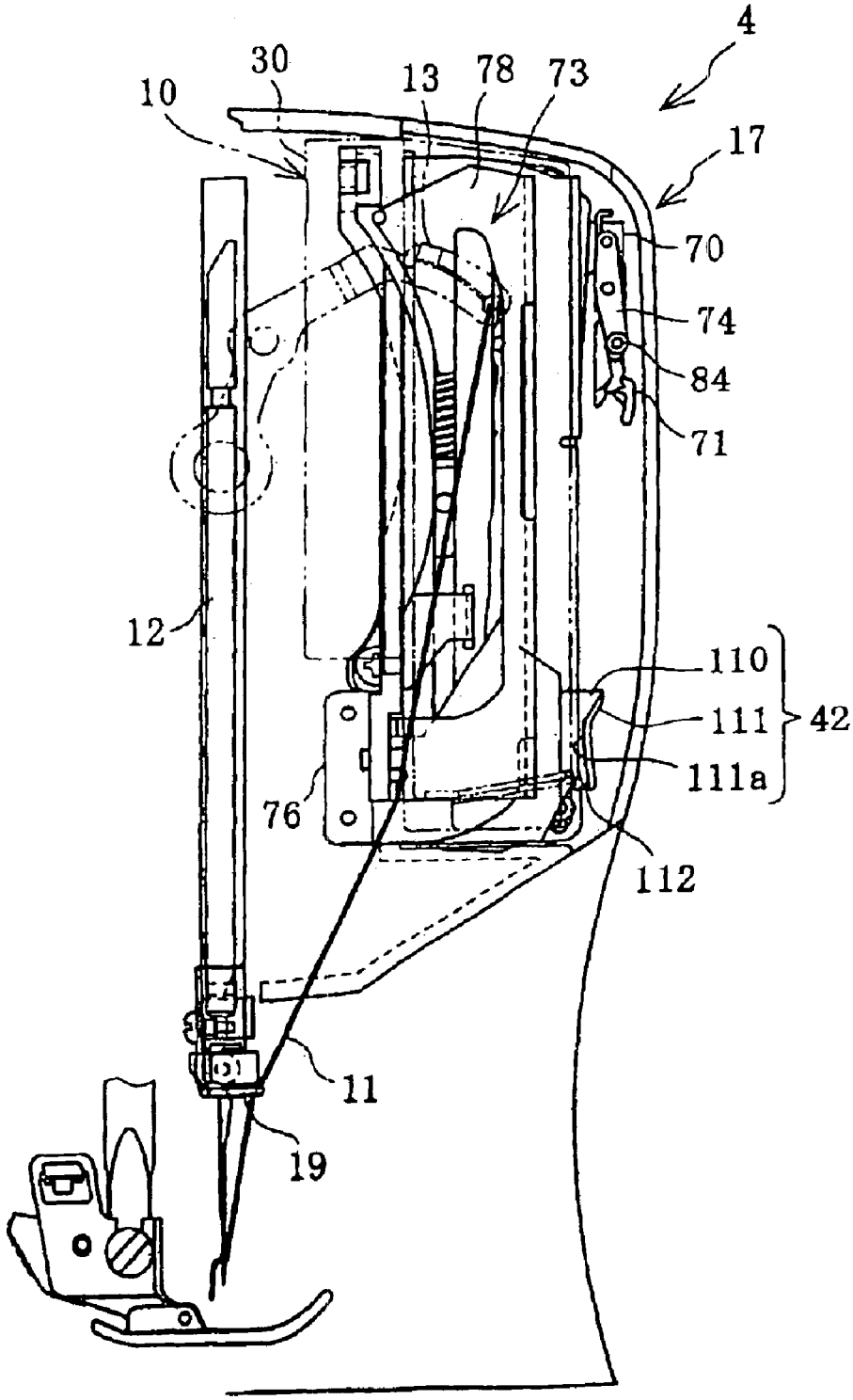
FIG. 10 is a side view of the sewing machine head when the threading operation has been completed.

Referring now to FIGS. 2 and 3, in the head 4 are provided a needle bar 12, a needle thread take-up lever 13 (see FIG. 10) and a thread tensioning mechanism 14 adjusting a thread tension of the needle thread drawn from the thread cassette 10. In the head 4 are further provided a threading mechanism 16 for automatically passing the needle thread 12 through an eye 15*a* of the needle 15 supported on the needle bar 12 when the thread cassette 10 is attached to the cassette mount 5, a principal portion of a thread holding mechanism 17 holding the needle thread 11 near the needle eye 15*a* for the threading by the threading mechanism 16, a thread guide threading mechanism 18 automatically threading a first thread guide 19 mounted on a lower end of the needle bar 12 and a second thread guide 20 provided near the lower end of the head 4.

The two thread guides 19 and 20 are separated away from each other in the lower portion of the head 4 by a predetermined distance. The thread guides 19 and 20 have thread guards 19*a* and 20*a* on which the needle thread 11 is caught, respectively (see FIGS. 24 to 27). The thread guards 19*a* and 20*a* are open substantially in the same direction (rightward) and substantially horizontal. In the head 4 are further provided a needle bar vertically moving mechanism for vertically moving the needle bar 12, a needle bar rocking mechanism for rocking the needle bar 12, and a needle thread take-up lever driving mechanism for vertically rocking the needle thread take-up lever 13.

The needle thread 11 drawn from the thread cassette 10 attached to the cassette mount 5 is caught, from above, on a thread tension shaft (not shown) between a pair of thread tension discs of the thread tensioning mechanism 14. The needle thread 11 extending downstream from the thread tension shaft is further guided to be caught on the needle thread take-up lever 13. Furthermore, the needle thread 11 extending downstream from the needle thread take-up lever 13 is passed through the needle eye 15*a* by the threading mechanism 16 after having been held near the needle eye 15*a* by the thread holding mechanism 17. The needle thread 11 is then caught on the thread guides 19 and 20 by the thread guide threading mechanism 18, whereupon the needle thread is set for the sewing operation. Each of the threading mechanism 16, thread holding mechanism 17 and thread guide threading mechanism 18 is automatically operated in synchronization with attachment of the thread cassette 10.

On the other hand, the bed 1 is provided with a bobbin mount (not shown) to which a bobbin is detachably attached. A thread extending from the bobbin serves as a bobbin thread. The bed 1 is further provided with a shuttle mechanism (not shown). When the needle and bobbin threads are set for the sewing operation and a sewing machine motor (not shown) is then driven, the needle bar 12 is vertically moved by the needle bar vertically moving mechanism. The shuttle mechanism is driven in synchronization with the vertical movement of the needle bar 12 so that the needle thread 11 is caught by the shuttle mechanism near the needle 15 lowered below a needle plate 1*a* of the bed 1, whereupon the needle and bobbin threads are entangled to be formed into stitches.

Figure 5:
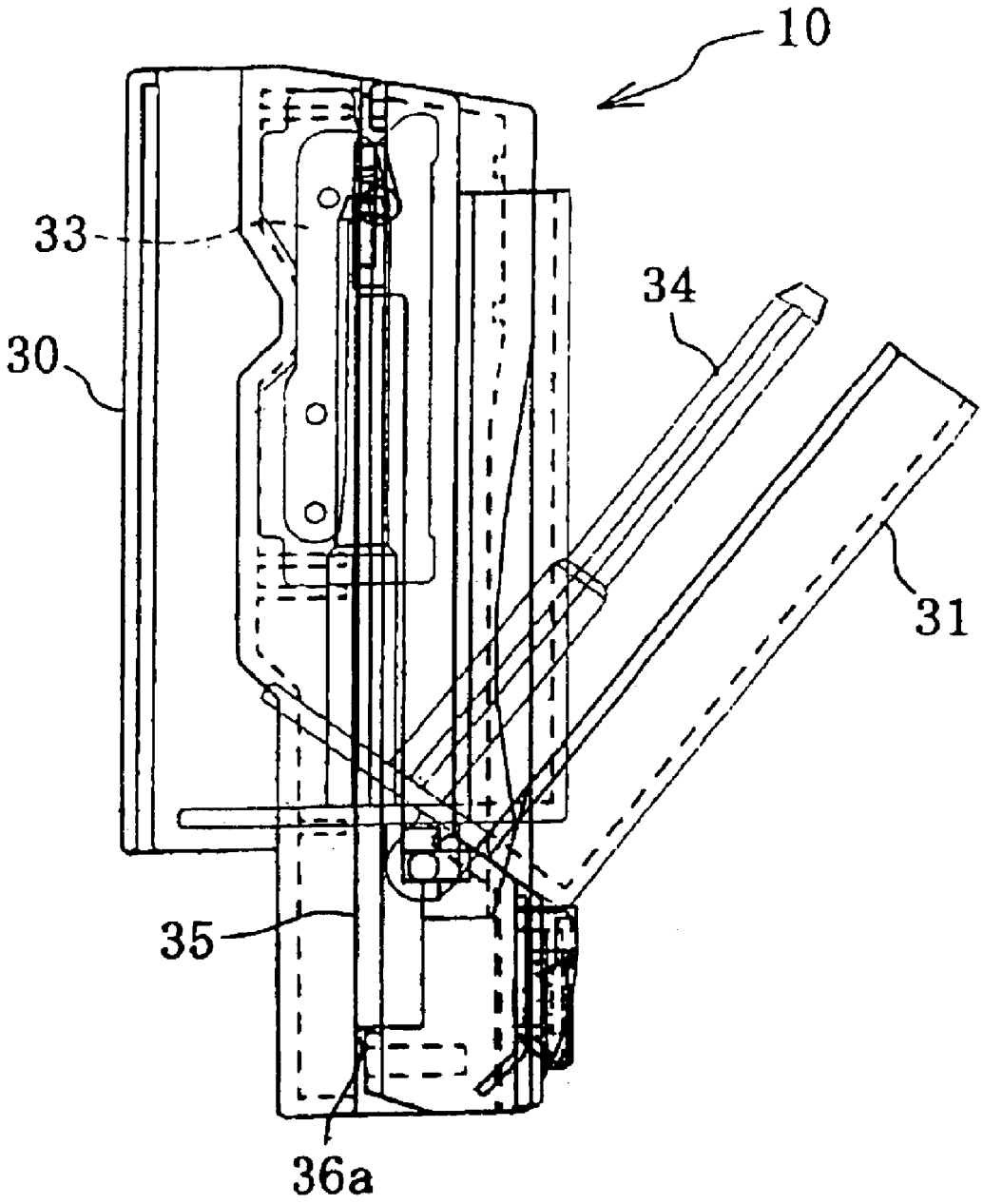
FIG. 5 is a left side view of the thread cassette.
Figure 6:
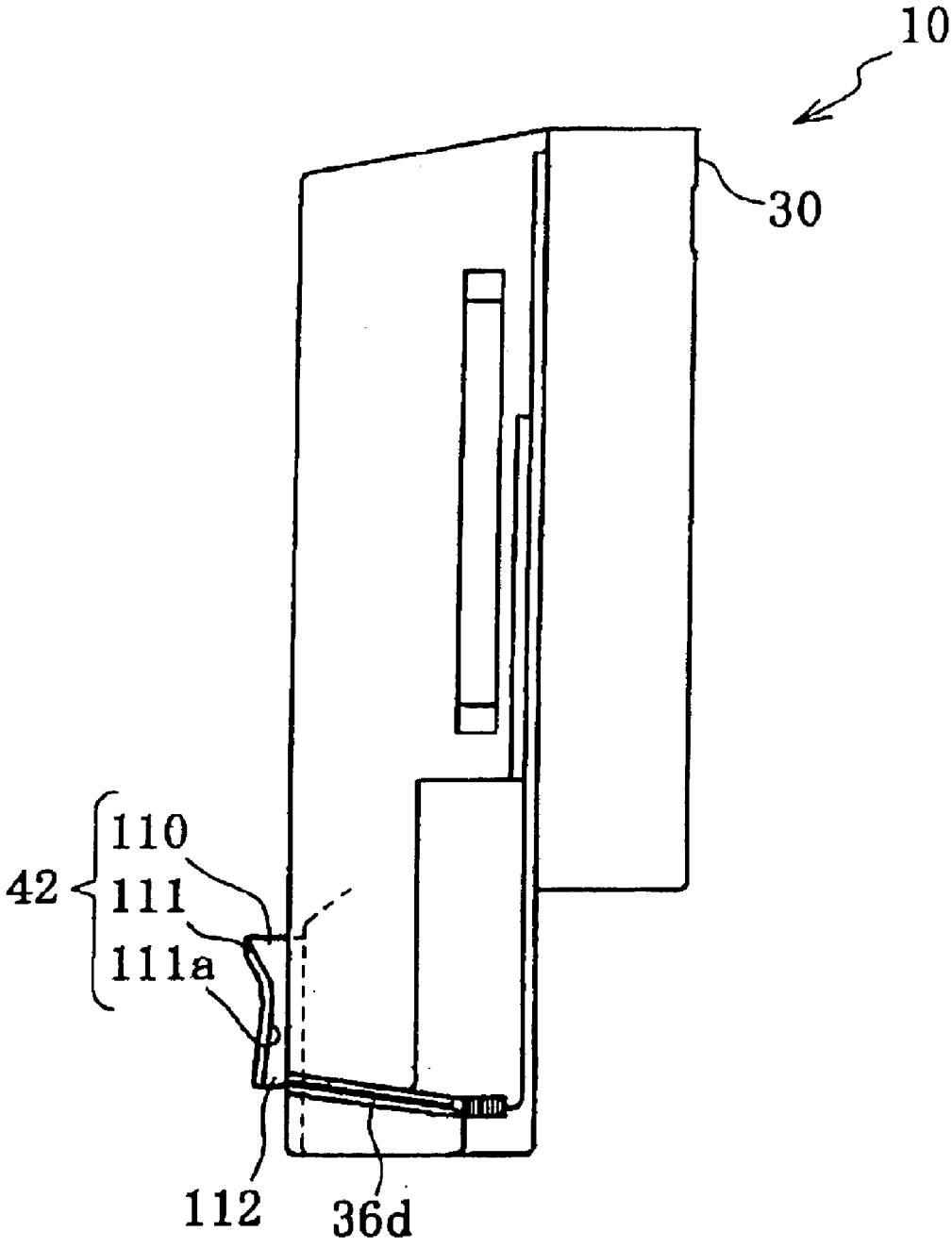
FIG. 6 is a right side view of the thread cassette.
Figure 7:
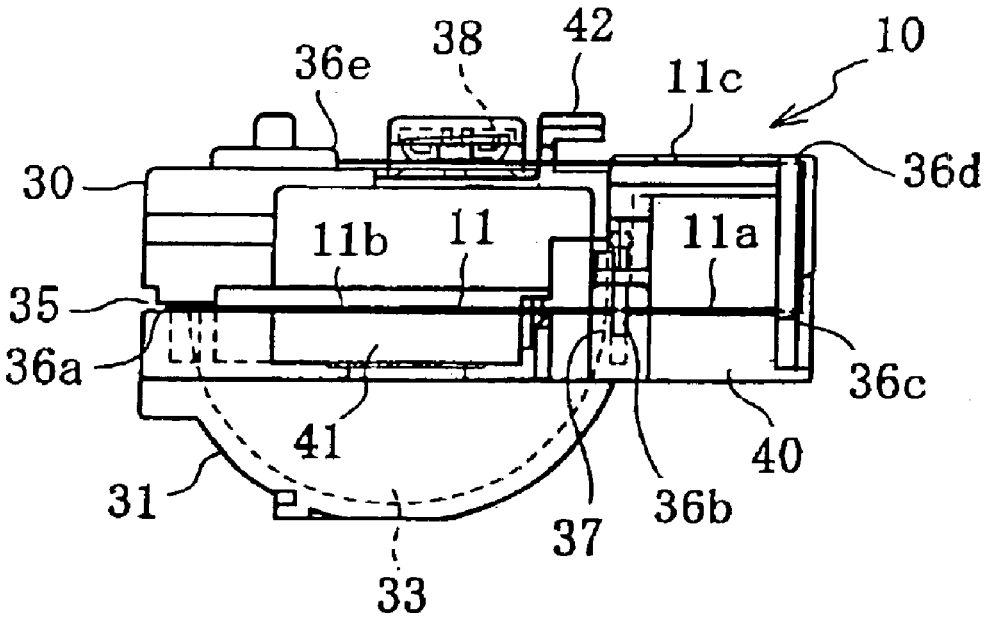
FIG. 7 is a bottom view of the thread cassette.

The thread cassette 10 will now be described in detail. The thread cassette 10 includes a cassette body 30 and a lid 31 pivotally mounted on the cassette body as shown in FIGS. 4 to 7. The cassette body 30 with the lid 31 defines therein a thread accommodating cavity 33 for accommodating a thread spool 32 serving as a supply of thread. A spool pin 34 is mounted on the lid 31. When the lid 31 is opened forward as shown in FIG. 5, the thread spool 32 is allowed to be attached to and detached from the spool pin 34. When the lid 31 is closed with the thread spool 32 attached to the spool pin 34, the thread spool is enclosed in the thread accommodating cavity 33.

The needle thread 11 is set in the following state when the thread cassette 10 has been attached to the cassette mount 5. The needle thread 11 extends upward from the thread spool 32 to be drawn out of the thread accommodating cavity 33. The thread 11 further extends through a thread path 35 defined between the cassette body 30 and a left-hand end of the lid 31. The thread 11 is then put on a first thread guard 36*a* at a left lower end of the thread cassette 10, further extending rightward thereafter to be put on a second thread guard 36*b* at a lower end of a partition wall 37 and a third thread guard 36*c* at a right lower end of the thread cassette 10. The thread 11 further extends forward to be put on a fourth thread guard 36*d* and is then returned to extend leftward. The thread 11 is then retained on a thread retainer 38. Furthermore, the thread 11 extending leftward is cut by a left blade 29 of the thread retainer 38 and the resultant thread end is put on a fifth thread guard 36*e* near the blade 39.

A needle thread take-up lever guide space 40 defined at a right end of the thread cassette 10 extends substantially over the length of the cassette. The guide space 40 is open at the rear and the lower portion of the cassette. A thread tensioning space 41 is defined at a central lower end of the thread cassette 10 and open at a lower portion thereof. These spaces 40 and 41 are partitioned by a partition wall 37. A pair of right and left escape grooves 43*a* and 43*b* are formed in the right-hand front of the thread cassette 10. The escape grooves 43*a* and 43*b* prevent a holding member 70 of the thread holding mechanism 17 from interference with the right-hand front of the thread cassette 10.

The thread cassette 10 is descended to be inserted into the cassette mount 5. In this case, the needle thread take-up lever 13 enters the guide space 40 from below the cassette, whereas the thread tensioning mechanism 14 enters the thread tension space 31 from below the cassette. When the thread cassette 10 has been inserted slightly into the cassette mount 5, a thread part 11*a* between the thread guards 36*b* and 36*c* is caught by the needle thread take-up lever 13 in the guide space 40.

Figure 22:
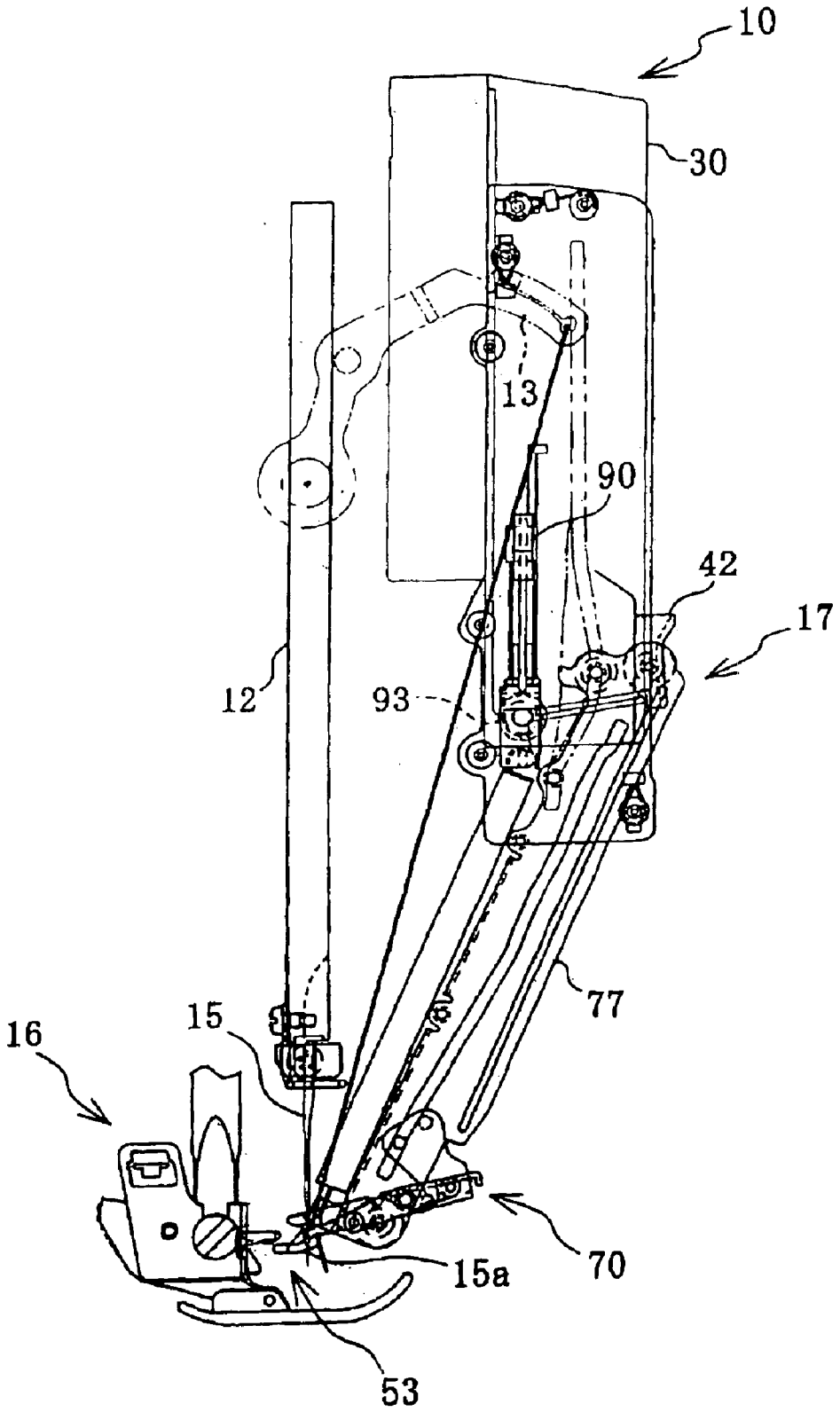
FIG. 22 is a partial side view of the sewing machine head immediately after the threading operation.

Subsequently, when the thread cassette 10 is further inserted into the cassette mount 5, a thread part 11*b* between the thread guards 36*a* and 36*b* is held by the thread tensioning mechanism 14 in the thread tension space 41. On the other hand, a thread part 11*c* between the thread guard 36*d* and the thread retainer 38 is drawn near the needle eye 15*a* by the thread holding mechanism 17 to be held as shown in FIG. 22. A cam member 42 which will be described later is provided between the thread guard 36*d* and the thread retainer 38. The cam member 42 rocks a thread holding member 74 of the thread holding mechanism 17.

Figure 8A:
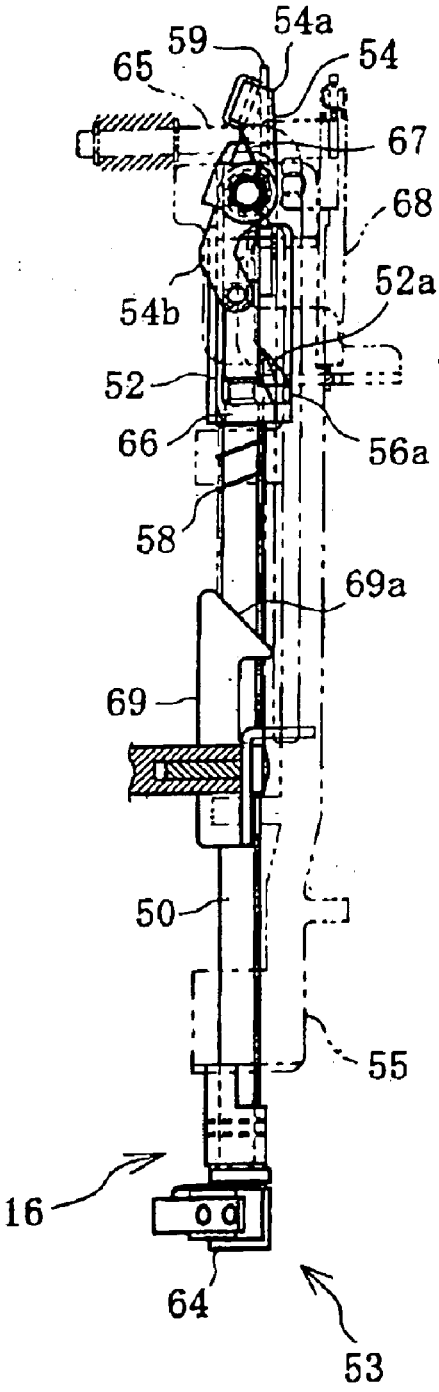
FIGS. 8A and 8B are a left side and front views of the threading mechanism respectively.
Figure 8B:
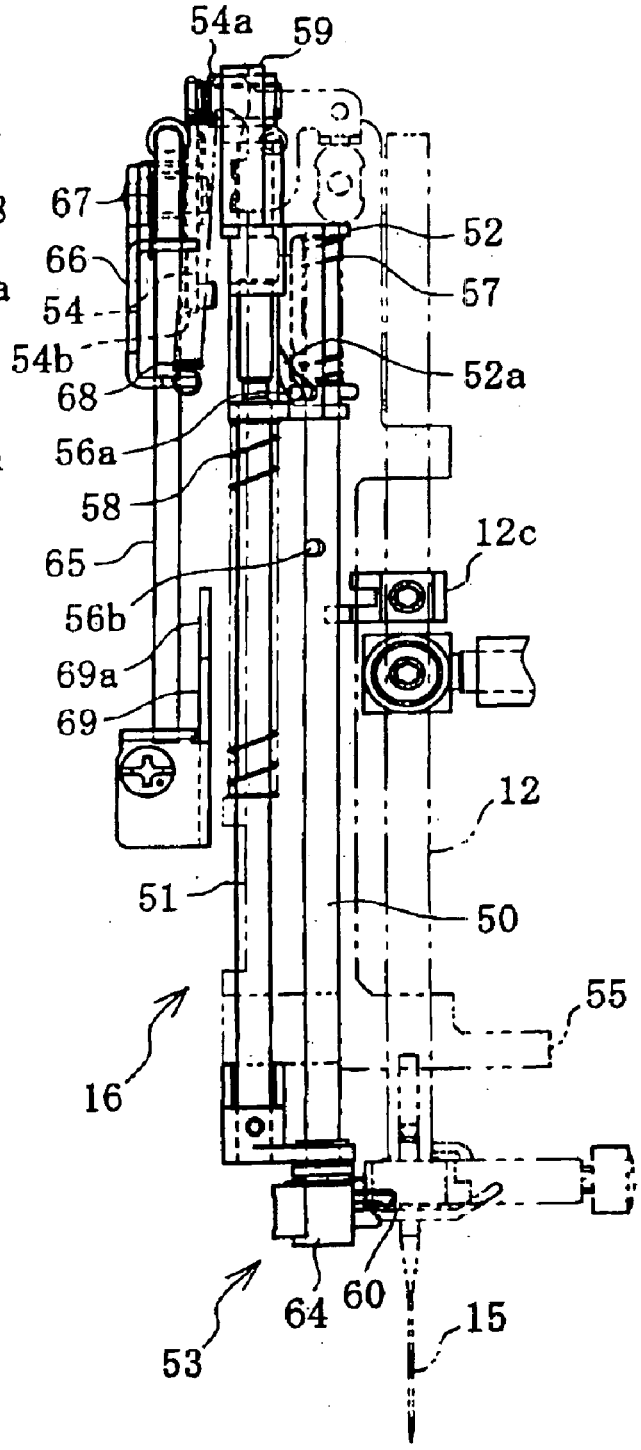

The threading mechanism 16 will be described. Referring to FIG. 8, the threading mechanism 16 includes a threading shaft 50 and a slider guide shaft 51 both provided on the left of the needle bar 12 for vertical movement, a threading slider 52 fitted with upper ends of the shafts 51 and 52 so as to be moved up and down, a hook mechanism 53 for passing the needle thread 11 through the needle eye 15*a* in synchronization with rotation of the threading shaft 50 coupled with the upper ends of the shafts 50 and 51, and a threading shaft driving member 54 for driving the threading shaft 50 in synchronization with the attaching operation of the thread cassette 10.

The threading shaft 50 and the slider guide shaft 51 are supported on the needle bar mount 55 together with the needle bar 12. The needle bar 12, threading shaft 50 and slider guide shaft 51 are rocked together by a needle bar rocking mechanism. The needle bar 12 (or needle 15) needs to be located at a predetermined position where the needle thread 11 held by the thread holding mechanism 17 can be passed through the needle eye 15*a* by the hook mechanism 53. For this purpose, the needle bar 12 is located at a leftmost position immediately before the threading operation by the threading mechanism 16 (immediately before attachment of the thread cassette 10). Furthermore, regarding the vertical position, the needle bar 12 is located at a position where the needle thread 11 can be passed through the needle eye 15*a* or more specifically, a predetermined position slightly lower than the uppermost position.

Two upper and lower pins 56*a* and 56*b* protrude from an upper portion of the threading shaft 50 and a vertically middle portion of the shaft. When the threading shaft 50 is lowered a predetermined amount, the pin 56*b* engages a limiting member 12*c* fixed to the vertically middle portion of the threading shaft 2. Furthermore, a coil spring 57 is provided around the threading shaft 50 for urging the threading slider 52 upward. Another coil spring 58 is provided around an upper half of the slider guide shaft 51 for urging the threading slider 52 upward. The threading slider 52 is formed with a cam groove 52*a* including an upper half straight groove and a lower half spiral groove. Furthermore, the threading slider 52 is provided with an upwardly protruding plate 59. The backside of the protruding plate 59 is formed into a horizontal plane (not shown).

Referring to FIGS. 8 and 9, the hook mechanism 53 includes a threading hook 60 for catching the needle thread 11, two guide members 61 and 62 disposed at both sides of the threading hook 60, a thread holding wire horizontally extending through the threading hook 60 and the guide members 61 and 62, and a hook holding member 64 fixed to the lower end of the threading shaft 50 and holding the threading hook 60 and guide members 61 and 62. The threading hook 60 has a distal end formed with a hook portion 60*a* as shown in FIG. 9. In the threading, the hook portion 60*a* is passed through the needle eye 15*a* and the threading hook 60 is guided by the two guide members 61 and 62. Under these conditions, the needle thread 11 held near the needle eye 15*a* by the thread holding mechanism 17 is caught by the threading hook 60.

A threading shaft driving member 54 is rotatably coupled to a slide member 66 fitted with a guide shaft 65 so as to be vertically slidable. The threading shaft driving member 54 is urged by a torsion coil spring 67 in the clockwise direction as shown in FIG. 8A. On the other hand, the slide member 66 is urged upward by a coil spring 68. The threading shaft driving member 54 has an upper end formed with a driving force transmitting portion 54*a* abutting the horizontal plane of the plate 59 to transmit a driving force to the threading slider 52 for the attachment of the thread cassette 10. The threading shaft driving member 54 has a lower end formed with a cam portion 54*b* for preventing the driving force from transmitting to the threading slider 54. The guide shaft 65 has a lower end to which a cam member 69 is fixed. The cam member 69 has an inclined distal cam portion 69*a*. The cam portion 54*b* abuts against the distal cam portion 69*a* when the threading shaft driving member 54 is moved downward a predetermined amount.

The threading operation by the threading mechanism 16 will now be described. When the threading shaft driving member 54 is driven downward against the urging force of the coil spring 68 in synchronization with attachment of the thread cassette 10, the driving force transmitting portion 54*a* abuts the horizontal plane of the plate 59 so that the driving force is transmitted to the plate 59, whereupon the threading shaft 51 and the slider guide 52 are moved downward, too. When the threading shaft 50 is moved downward a predetermined amount, the pin member 56*b* engages the limiting member 12*c* thereby to prevent further downward movement of the threading shaft 50. However, the threading slider 52 is further moved downward against the urging force of the coil spring 58. Since the pin member 56*a* of the threading shaft 50 is moved along the cam groove 52*a* of the threading slider 52 relative to the threading shaft 50, the downward movement of the threading slider 52 relative to the threading shaft 50 is converted to rotational movement of the threading shaft 50, whereby the shaft 50 pivots a predetermined angle. In this case, as shown in FIG. 9A, the hook mechanism 53 provided at the lower end of the threading shaft 50 is also rotated with the threading shaft, whereupon the hook portion 60*a* of the threading hook 60 is passed through the needle eye 15*a* and catches the needle thread 11.

Figure 9A:
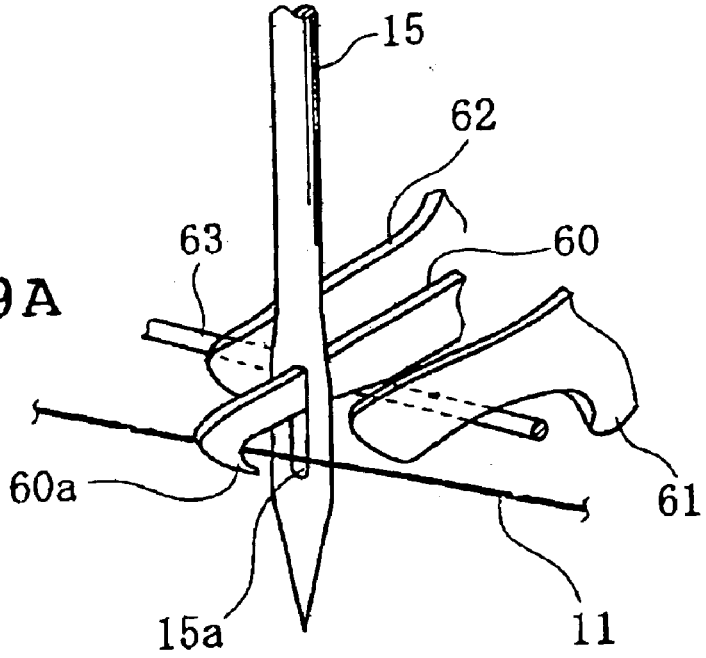
FIGS. 9A and 9B are perspective views of the hook mechanism immediately before threading and upon completion of threading respectively.
Figure 9B:
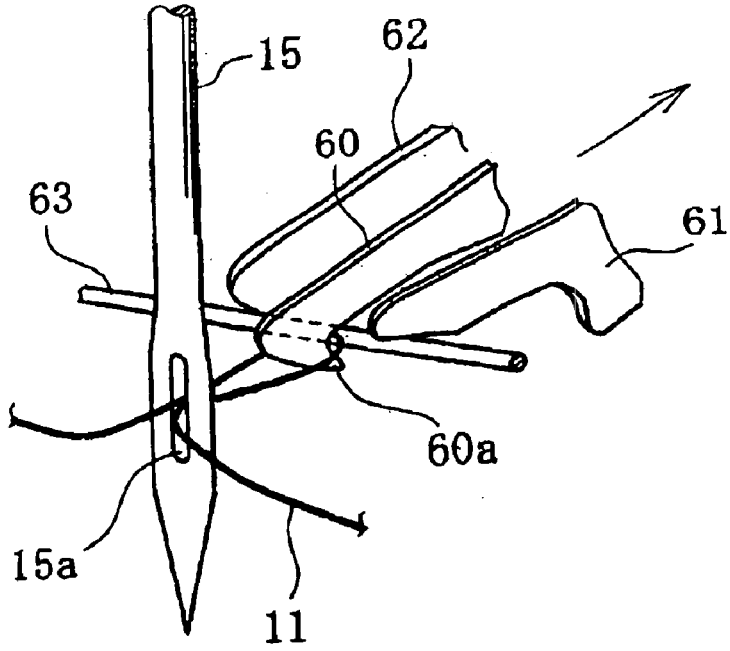

While the needle thread 11 is caught on the hook 60*a*, the threading shaft driving member 54 is moved downward to a predetermined position and the cam portion 54*b* abuts the distal cam portion 69*a* of the cam member 69, as shown in FIG. 9A. Furthermore, when the thread cassette 10 is further pushed into the cassette mount 5 such that the threading shaft driving member 54 is moved downward, the threading shaft driving member 54 is rotated counterclockwise against the urging force of the torsion coil spring 67 as shown in FIG. 8A. Consequently, since the driving force transmitting portion 54*a* departs from the horizontal plane of the protruding plate 59, the driving force for driving the threading shaft 50 downward is not transmitted. Accordingly, the threading shaft 50 is rotated in the opposite direction and returned upward by the urging force of the coil spring 58. With this, since the hook mechanism 53 is rotated in such a direction as to depart from the needle 15, the threading hook 60 catching the needle thread 11 is pulled through the needle eye 15*a* as shown in FIG. 9B, thereby completing the threading operation.

The thread holding mechanism 17 will now be described. The thread holding mechanism 17 includes a holding member 70 having a pair of spaced-apart thread holding portions 71 and 72 capable of holding the needle thread 11, a synchronous moving mechanism 73 for moving the thread holding portions 71 and 72 near the needle eye 15*a* in synchronization with attachment of the thread cassette 10, a thread holding member 74 releasably holding the needle thread 11 between the left thread holding portion 71 and itself, a torsion coil spring 75 (urging member) elastically urging the thread nipping member 74 toward the holding portion 71, and a cam member 42 mounted on the cassette body 30 of the thread cassette 10 and rocking a thread nipping member 74 to a side where the needle thread 11 is temporarily released in synchronization with a predetermined stage of the step of attaching the thread cassette, as shown in FIGS. 3, 6 and 10 to 12.

The thread holding mechanism 17 further includes a base frame 76 fixed to the head 4 and a moving frame 77 supported so as to be moved upward and downward. The holding member 70 is fixed to the moving frame 77 which serves as a moving member and is moved by a sequential moving mechanism 73. The base frame 76 has guide members 78 located at both sides of the vertical movement path of the needle thread take-up lever 13 and a pair of guide plates 79*a* and 79*b* (see FIG. 3) provided on the left of the guide members for guiding the moving frame 77. The moving frame 77 comprises a pair of moving plates 80*a* and 80*b* provided between the guide plates 79*a* and 79*b*. The moving plates 80*a* and 80*b* are connected to each other by a plurality of connecting pins.

Figures 11A, 11B, 11C:
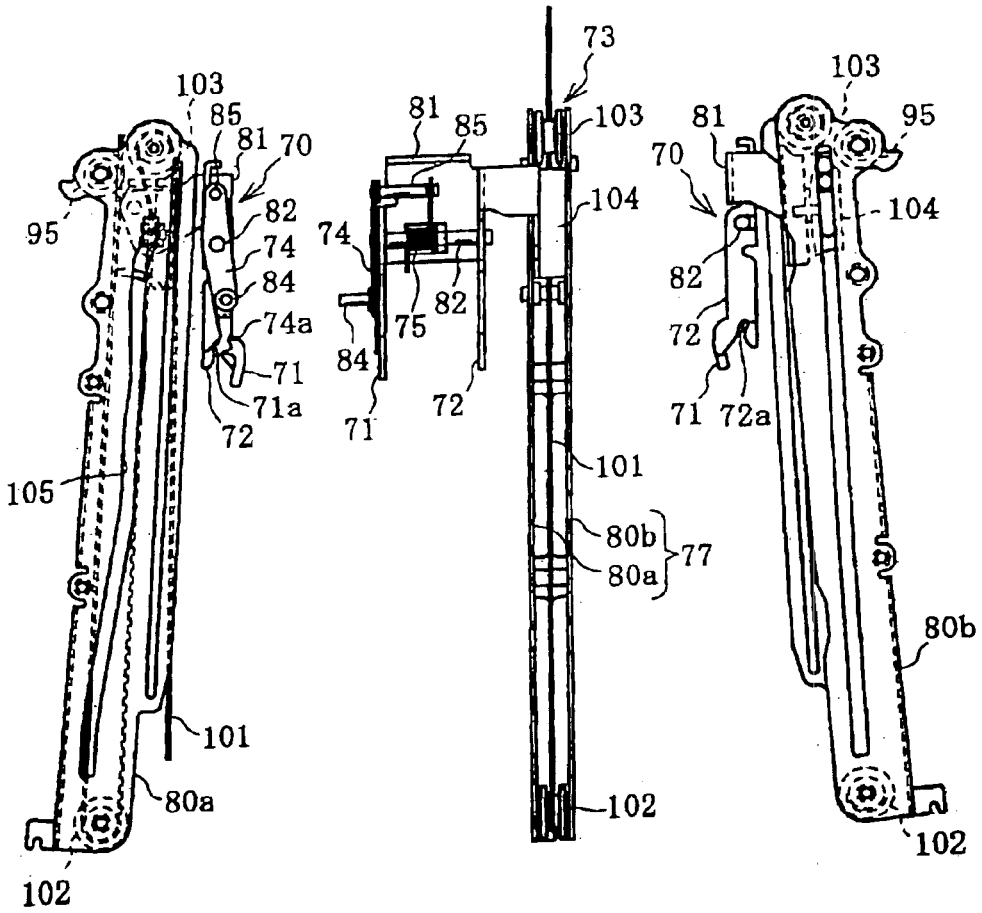
FIGS. 11A, 11B and 11C are left side, front and right side views of the holding member and moving frame, respectively.

The holding member 70 and the thread nipping member 74 will be described with reference to FIGS. 11A to 11C. The thread holding portions 71 and 72 of the holding member 70 are connected to each other by a connecting member 81. The connecting member 81 has a right end extending horizontally rightward and is fixed to a holding member support 104 further fixed to a second wire 101 of the interlock transfer mechanism 73. The thread holding portions 71 and 72 are formed with recesses 71*a* and 72*a* for catching the needle thread 11 in the attachment of the thread cassette 10 respectively. The thread nipping member 74 is mounted on a pivot shaft 82 further pivotally mounted on the left-hand thread holding portion 71. A torsion coil spring is provided around the pivot shaft 82.

The thread nipping member 74 has a lower end including a front portion formed with a recess 74*a* holding the needle thread 11 in cooperation with the left thread holding portion 71 therebetween. A driven pin 84 is provided on the lower end so as to be operated by a cam member 42 as will be described later. On the other hand, the thread nipping member 74 has an upper end (which is opposed to the driven pin 84 relative to the pivot shaft 82) on which a limit pin 85 is provided. The limit pin 85 limits a rocking motion of the thread nipping member 74 to a thread holding side over a predetermined range. The driven pin 84 protrudes leftward and the limit pin 85 protrudes rightward.

Figure 12:
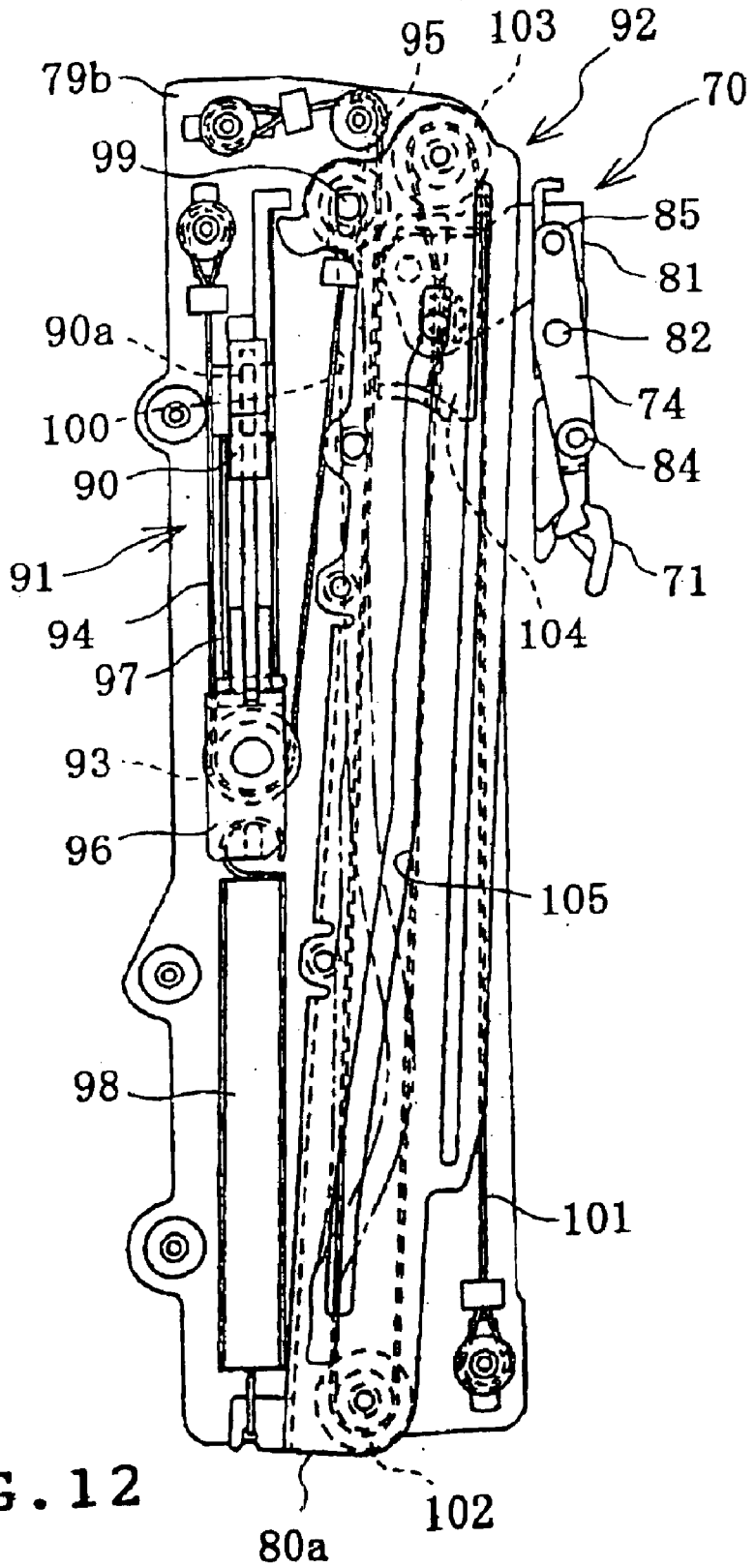
FIG. 12 is a side view of the holding member and synchronous moving mechanism.

The interlock transfer mechanism 73 will be described. Referring to FIGS. 11A to 12, the interlock transfer mechanism 73 comprises a cassette contact 90 serving as an operating force transmitting member and made of a synthetic resin and coming into contact with the thread cassette 10 to be lowered with the cassette during attachment of the thread cassette. The interlock transfer mechanism 73 further includes first and second running blocks 91 and 92 moving the holding member 70 by an amount four times larger than an amount of movement of the cassette contact 90. The cassette contact 90 is vertically movable between right and left guide plates 79*a* and 79*b* of the base frame 76. The cassette contact 90 has a contact portion 90*a* formed on the left end side thereof so as to protrude leftward from the left-hand guide plate 79*a*. The lower end of the thread cassette 10 is brought into contact with the contact portion 90*a*. An operating force is transmitted to the cassette contact 90 from outside the thread holding mechanism 17, for example, the thread cassette 10.

The first running block 91 comprises a pulley 93 coupled with the cassette contact 90 so as to be vertically moved together, a first wire 94 wound on the pulley 93 and having one end fixed to the guide plate 79*b*, and a pulley 95 connected to the other end of the first wire 94. The pulley 93 is enclosed in a pulley enclosing member 96 made of a synthetic resin. The pulley enclosing member 96 is vertically movable together with the pulley 93 between the paired guide plates 79*a* and 79*b* below the cassette contact 90. A coil spring 97 is provided between the cassette contact 90 and the pulley enclosing member 96 for urging the cassette contact 90 upward relative to the pulley 93. On the other hand, the pulley 93 (and the pulley enclosing member 96) is urged upward by a coil spring 98 which returns the moving frame 77 upward. The coil spring 98 has a lower end connected to a lower end of the left moving plate 80*a*.

The first wire 94 has one end fixed to a portion of the guide plate 79 located above the cassette contact 90 and the other end fixed to a pin member 99 connecting the upper ends of the moving plates 80*a* and 80*b*. The pin member 99 is supported by the guide plates 79*a* and 79*b* so as to be moved vertically along a guide groove 100. The pulley 95 is rotatably supported on the pin member 99. Accordingly, the pulley 95 and the moving plates 80*a* and 80*b* (or moving frame 77) are vertically movable relative to the guide plates 79*a* and 79*b* (or fixed frame 76) under the condition where the pin member 99 is guided by the guide groove 100.

When the cassette contact 90 comes into contact with the thread cassette 10 to be pushed downward during attachment of the thread cassette, the pulley 93 is also pushed downward together with the thread cassette 10. Since the pulley 93 serves as a running block in this case, the pulley 95 and accordingly the moving frame 77 are moved downward by an amount twice as large as an amount of movement of the cassette contact 90.

The second running block 92 comprises a second wire 101 having both ends fixed to the guide plate 79*b* and two pulleys 102 and 103 on both of which the second wire is wound. The pulleys 102 and 103 are rotatably supported on the lower and upper ends of the moving plates 80*a* and 80*b* respectively. The one end of the second wire 101 is fixed to the upper end of the guide plate 79*b*, whereas the other end of the second wire 101 is fixed to the lower end of the guide plate 79*b* while the second wire is wound on the pulleys 102 and 103.

Figure 13A:
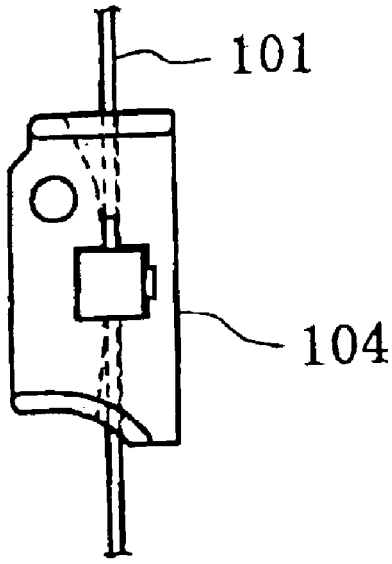
FIGS. 13A and 13B are left and right side views of the holding member support respectively.
Figure 13B:
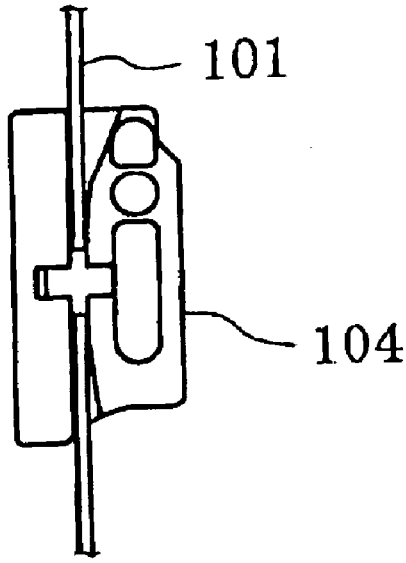
Figure 14:
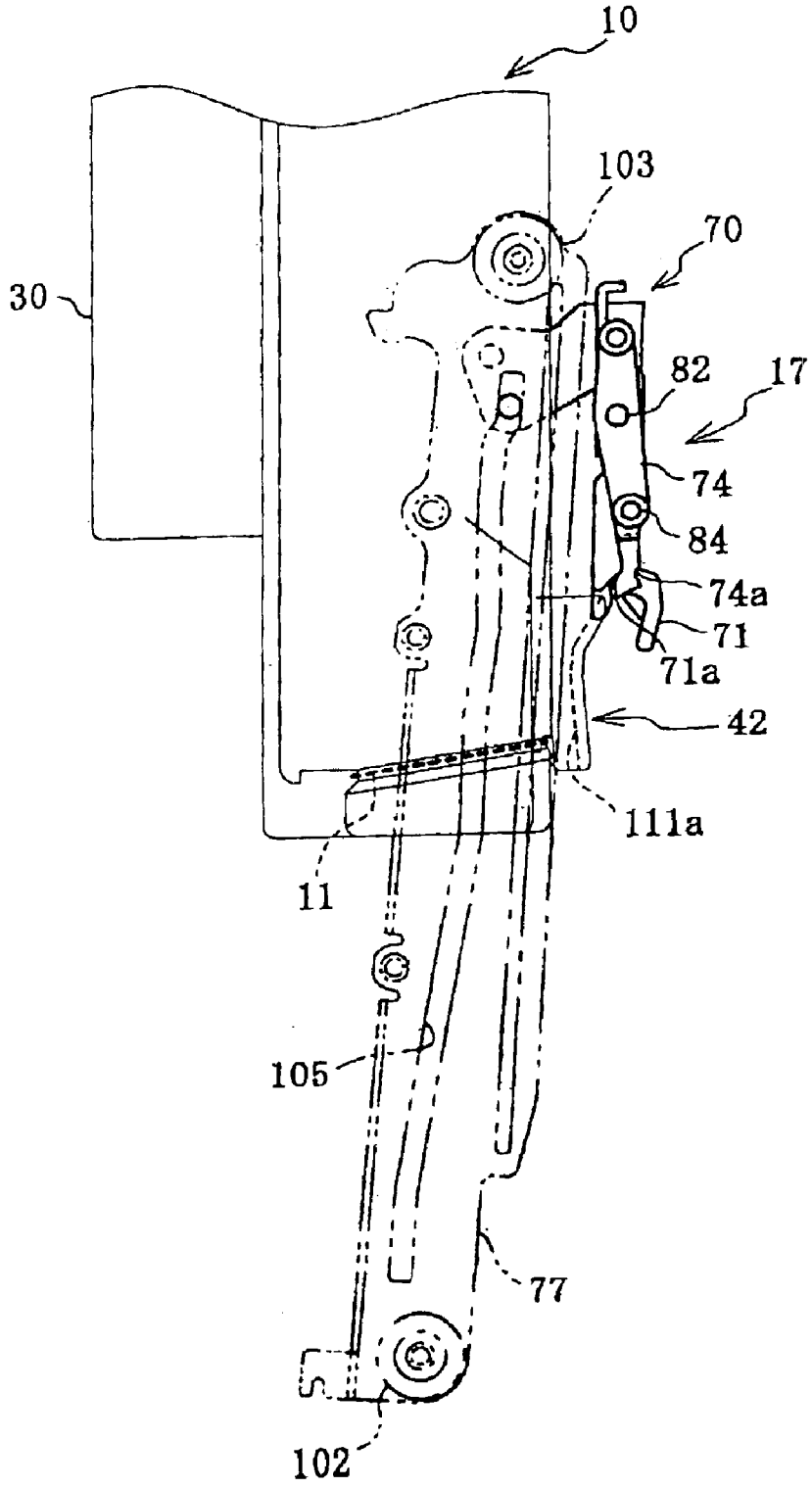
FIG. 14 illustrates a working condition of the holding member and thread holding member (immediately before movement of the holding member)

Referring to FIGS. 12 to 13B, a holding member support 104 made of a synthetic resin is fixed to a portion of the second wire 101 located between the pulleys 102 and 103. The connecting member 81 of the holding member 70 is connected to the holding member support 104. The connecting member 81 and the holding member support 104 are supported so as to be movable vertically along the guide groove 105 between the paired moving plates 80*a* and 80*b*.

When the moving plates 80*a* and 80*b* are moved downward by the first running block 91, the pulleys 102 and 103 are also moved downward with movement of the moving plates 80*a* and 80*b*. The pulley 102 thus serves as a running block in this case. When a portion of the wire 101 wound on the pulley 102 is thrust downward, the second wire 101 is moved from the front side of the pulley 102 (right side as viewed in FIG. 12) to the rear side (left side as viewed in FIG. 12) by an amount twice as large as an amount of movement of the pulley 102. In other words, the holding member 70 connected to the portion of the second wire 101 between the pulleys 102 and 103 is also moved downward by an amount twice as large as an amount of movement of the pulley 102. Accordingly, an amount of movement of the holding member 70 becomes four times larger than an amount of movement of the thread cassette 10.

The cam member 42 will now be described. Referring to FIGS. 4, 6, 7 and 10, the cam member 42 is formed integrally in the right rear end of the cassette body 30 so as to protrude from the front of the cassette body. The cam member 42 includes a protruding portion 110 protruding forward from the front of the cassette body 30 and a cam portion 111 extending rightward from the front end of the protrusion 110. A pin passage 112 is defined between the cam portion 111 and the front of the thread cassette 10. The drive pin 84 is passed through the pin passage 112 relative to the thread cassette 10 during attachment of the cassette.

The cam portion 111 has a cam face 111*a* formed in the rear thereof. The driven pin 84 is moved or slid along the cam face 11*a* during attachment of the thread cassette 10. The cam face 111*a* has an upper inclined face inclined downwardly rearward and a lower inclined face continuous to the lower end of the upper inclined face and inclined downwardly forward. Thus, the cam face 111*a* facing the front of the thread cassette 10 is formed so as to protrude rearward. A boundary portion of the upper and lower inclined faces is bent, and the cam face 111*a* protrudes rearmost at the bent portion. Accordingly, the driven pin 84 is passed through the pin passage 112 along the cam face 111*a* as the thread cassette 10 is moved downward. Thus, the driven pin 84 is operated by the cam member 42 so that the thread nipping member 74 is rocked back and forth. At this time, the needle thread 11 is held between the thread holding portion 71 and the thread nipping member 74.

Figure 15:
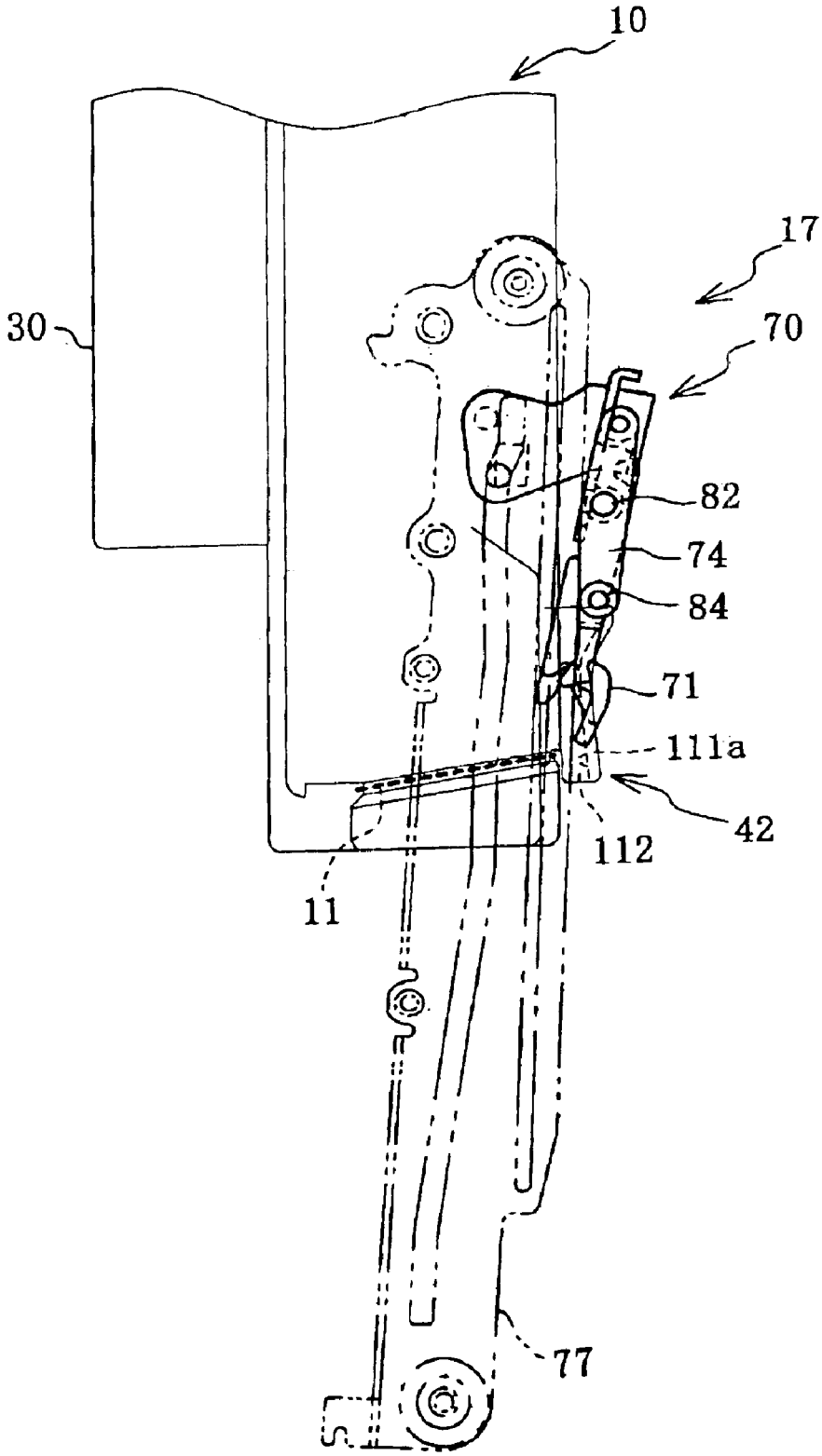
FIG. 15 also illustrates another working condition of the holding member and thread holding member (immediately after start of movement of the holding member)

Referring to FIGS. 10 and 14 to 23, the thread holding operation of the thread holding mechanism 17 will be described with main attention to the holding of the needle thread 11 by the thread holding portion 71 and the thread nipping member 74. The thread nipping member 74 is urged to the thread holding side by the torsion coil spring 75 immediately after the thread cassette 10 comes into contact with the cassette contact 90. When the thread cassette 10 is then thrust into the cassette mount 5, the holding member 70 is moved downward in synchronization with attachment of the threads cassette 10, as shown in FIG. 15. The holding member 70 is moved downward relative to the thread cassette 10 since a movement amount of the holding member 70 is rendered four times larger than a movement amount of the thread cassette 10 by the first and second running blocks 91 and 92.

Figure 16:
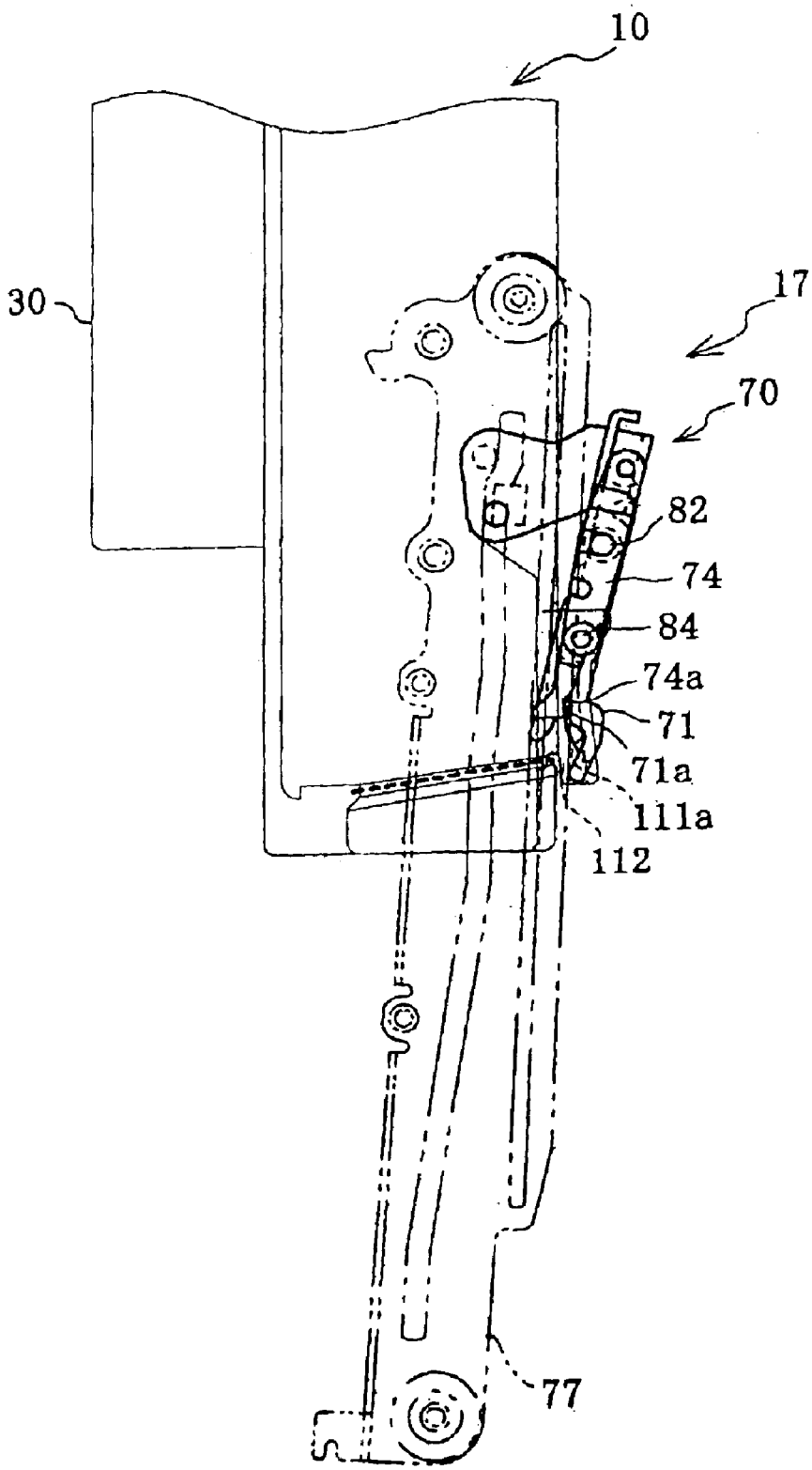
FIG. 16 illustrates further another working condition of the holding member and thread holding member (at the start time of the rocking motion of the thread nipping member)
Figure 17:
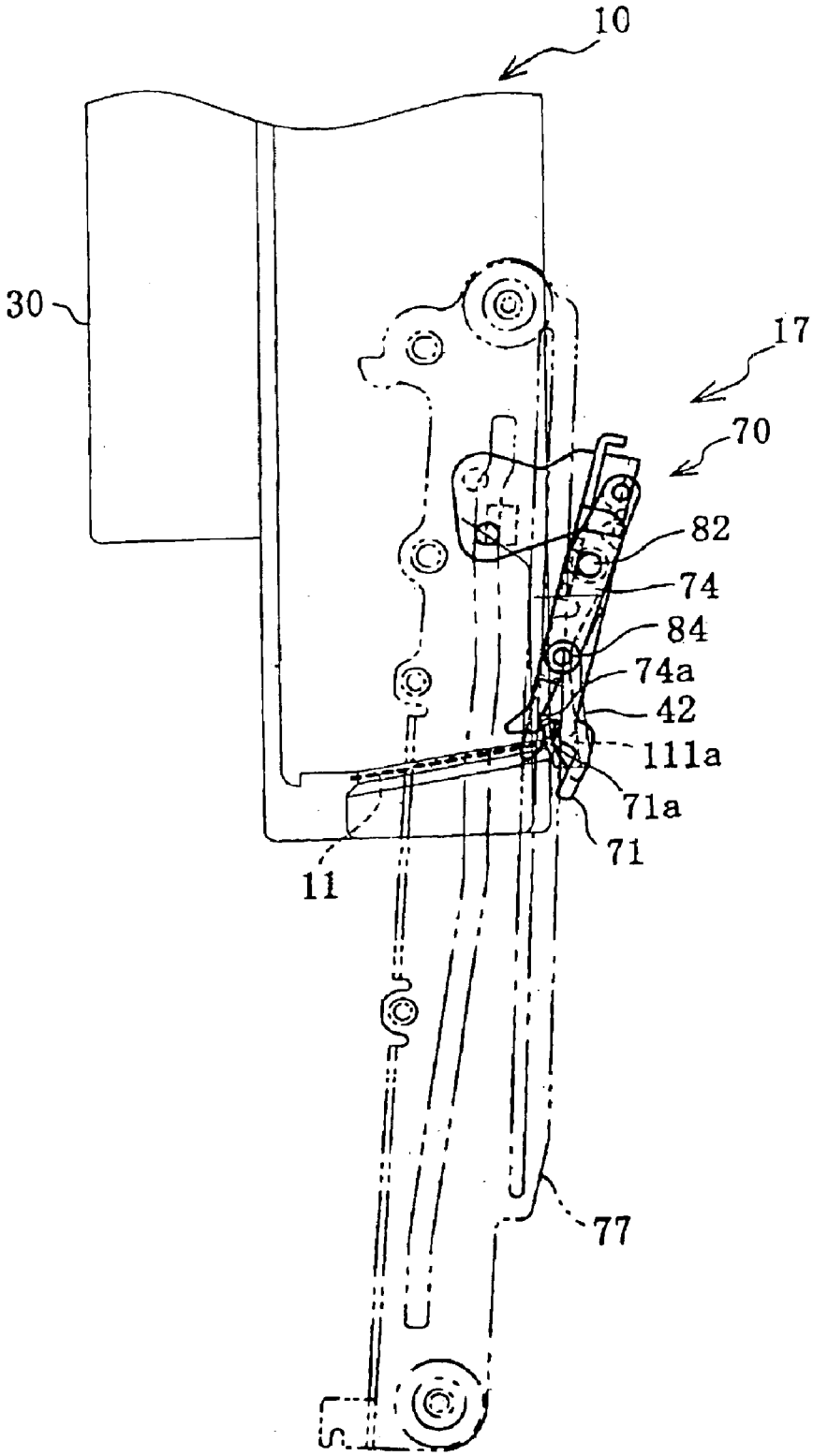
FIG. 17 illustrates further another working condition of the holding member and thread holding member (in the maximum rocking motion of the thread nipping member)

The driven pin 84 is thrust rearward by the cam face 111*a* when reaching the pin passage 112 formed inside the cam member 42, as shown in FIG. 16. With this, the thread holding member 74 starts to be rocked about the pivot shaft 82 to the hold releasing side. Upon further downward movement of the holding member 70, the thread nipping member 74 is rocked to the hold releasing side to the maximum extent when the driven pin 84 reaches a rearmost protruding portion of the cam face 111*a*, as shown in FIG. 17. At this time, the portion 11*c* (see FIGS. 4 and 7) of the needle thread 11 extending in front of the thread cassette 10 enters a space between the recesses 71*a* and 74*a* of the thread holding portion 71 and the thread nipping member 74.

Figure 18:
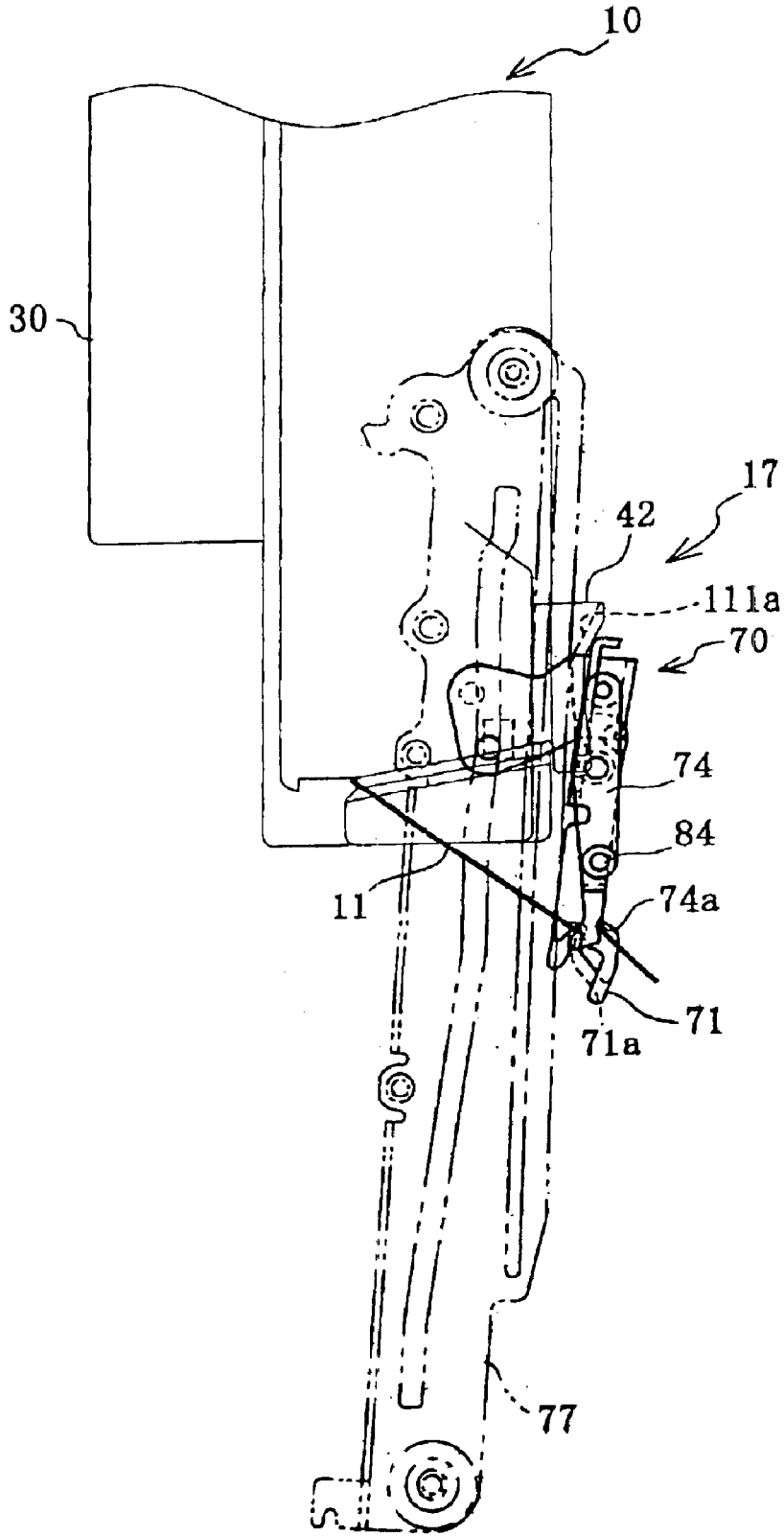
FIG. 18 illustrates further another working condition of the holding member and thread nipping member (at the completion time of the rocking motion of the thread nipping member)

When the driven pin 84 is further moved downward along the cam face 111*a* and passes a farthest protruding portion of the cam face 111*a* within the pin passage 112, the thread nipping member 74 is urged by the torsion coil spring 75 (see FIG. 11B) to be rocked to the thread holding side. When the driven pin 84 passes through the pin passage 112 thereby to loose contact with the cam face 111*a*, the needle thread 11 is held between the recesses 71*a* and 74*a* of the thread holding portion 71 and the thread nipping member 74, as shown in FIG. 18. The limit pin 85 is upwardly spaced away from the recesses 71*a* and 74*a*.

Figure 19:
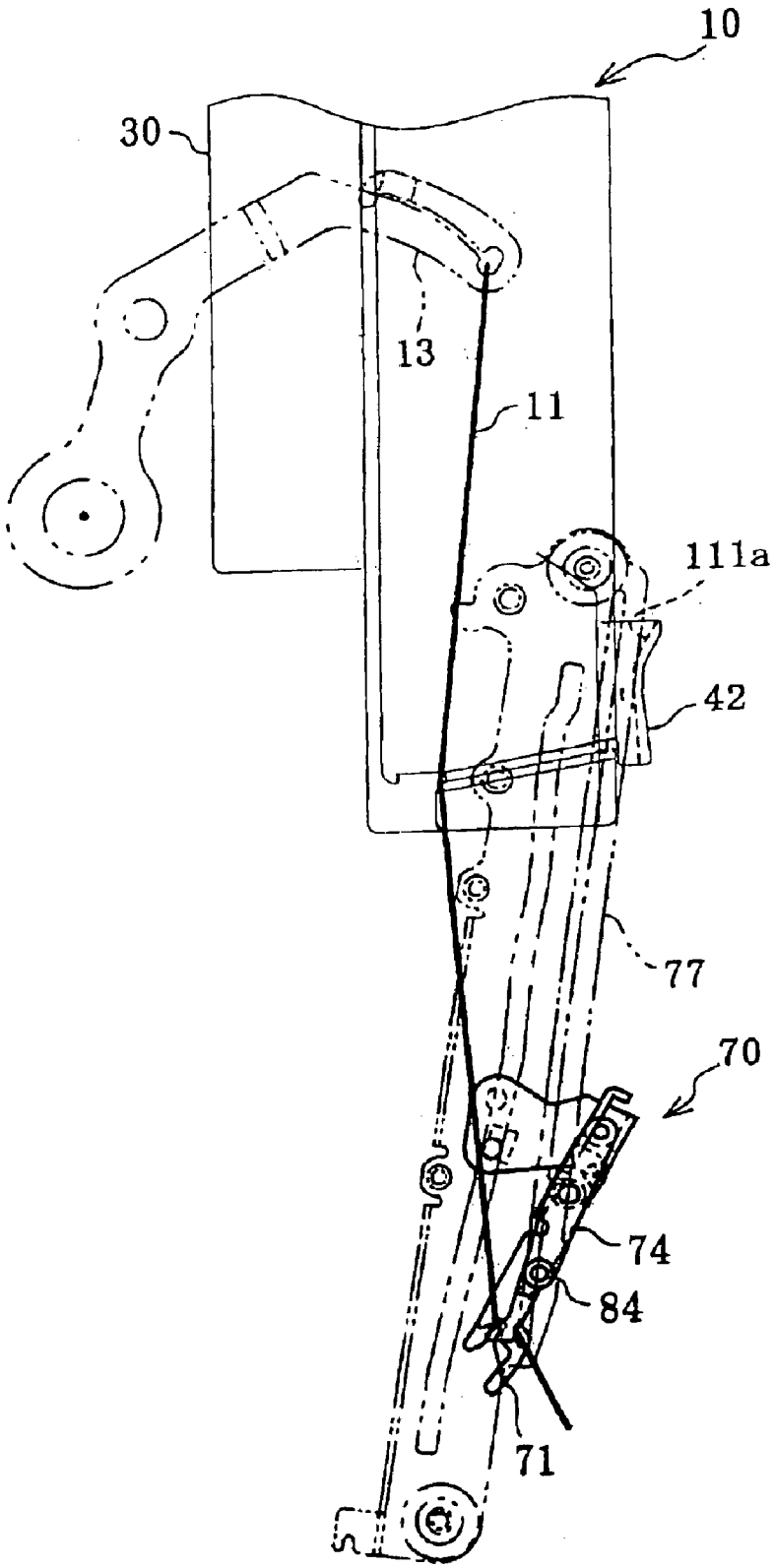
FIG. 19 illustrates further another working condition of the holding member and thread holding member (while holding the needle thread)
Figure 20:
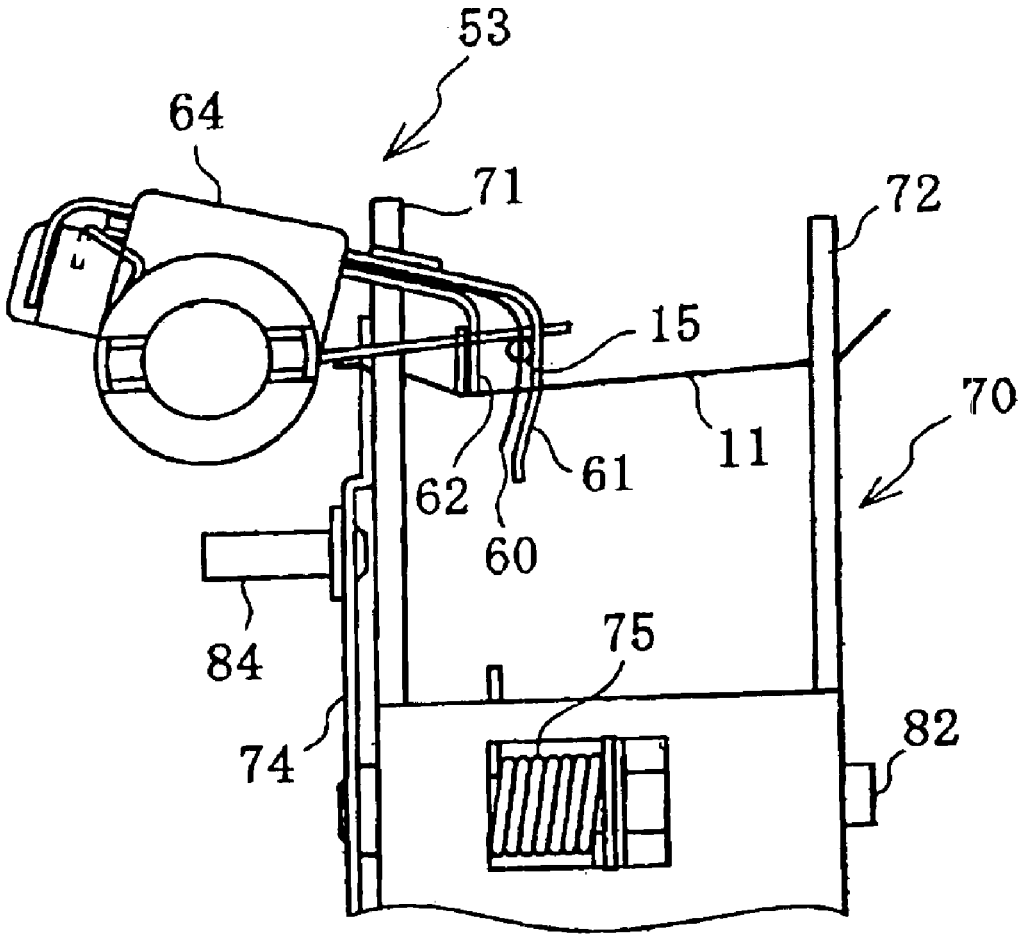
FIG. 20 is a partial plan view of the hook mechanism and holding member in the threading operation.

Thus, the moving frame 77 is further moved downward as shown in FIG. 19 while the needle thread 11 is held as described above. The needle thread 11 is held near the needle eye 15*a* by the thread holding portions 71 and 72. At this time, the hook mechanism 53 of the threading mechanism 16 is rotated clockwise such that the threading hook 60 passes through the needle eye 15*a* as shown in FIG. 20.

Figure 21:
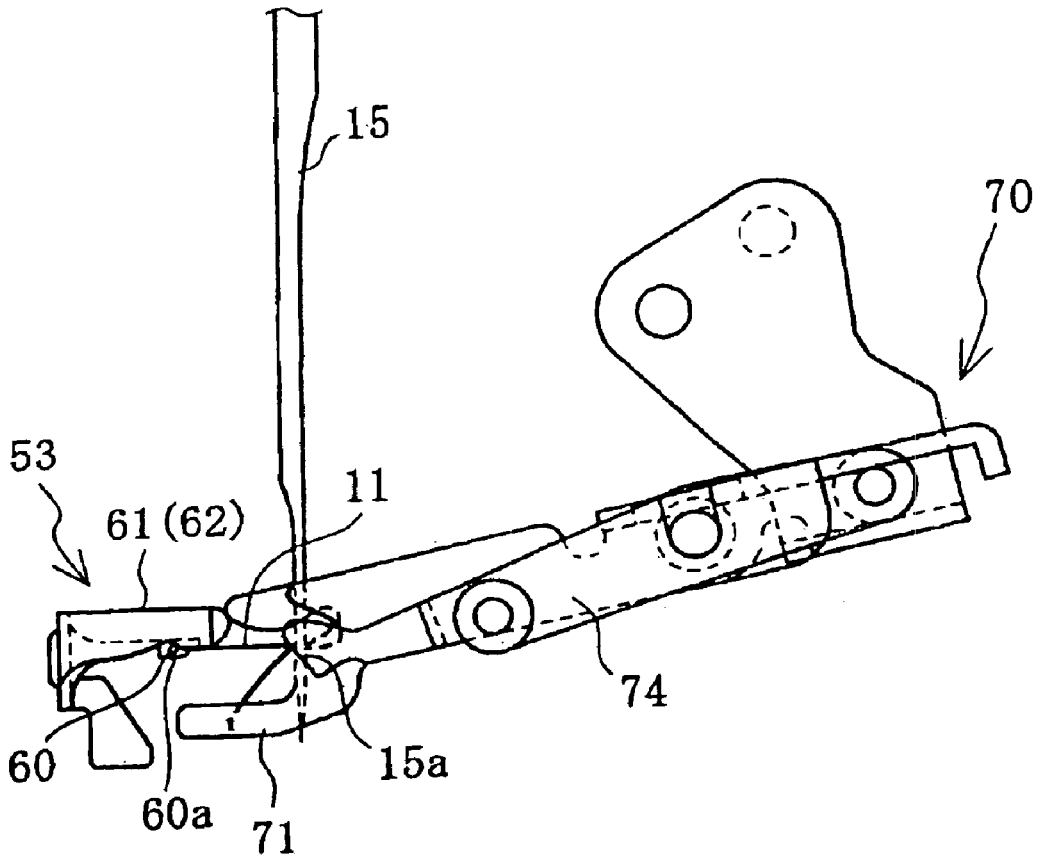
FIG. 21 is a side view of the hook mechanism and holding member in the threading operation as shown in FIG. 20.

When the holding member 70 is moved near the needle eye 15*a*, the cassette contact 90 thrust downward in contact with the lower end of the thread cassette 10 departs from the thread cassette, and the pulley 93 is moved upward by the urging force of the return coil spring 98. With this return movement, the moving frame 77 and the holding member 70 are moved upward. The needle thread 11 held by the thread holding portions 71 and 72 is caught on the threading hook 60. The hook mechanism 53 is returned counterclockwise in FIG. 20 while the needle thread 11 is caught on the threading hook 60. As a result, the needle thread 11 is passed through the needle eye 15*a* as shown in FIGS. 21 and 22.

Figure 23:
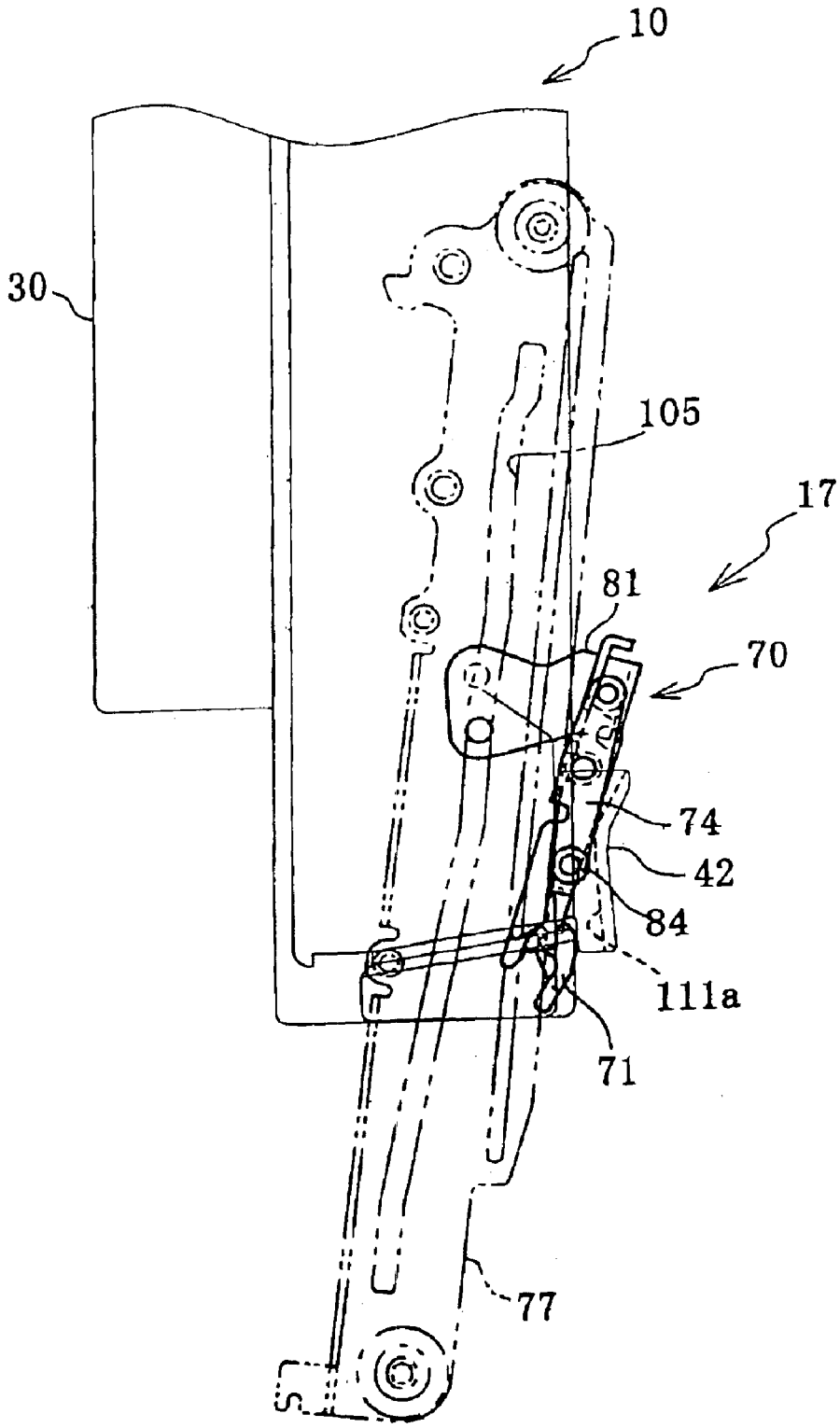
FIG. 23 illustrates a working condition of the holding member and thread nipping member (after the threading operation)

The holding member 70 is moved upward with the moving frame 70 when the needle thread 11 has been passed through the needle eye 15*a*. In this case, as shown in FIG. 23, the position where the connecting member 81 engages the guide groove 105 differs from that in the case where the holding member 70 is moved downward (see FIG. 18). Accordingly, since the driven pin 84 is spaced away from the cam face 111*a* of the cam member 42, these are prevented from interference. Consequently, the holding member 70 is smoothly moved upward. The limit pin 85 is located on the right of the thread nipping member 74 and spaced away from the cam member 42 rightward. Accordingly, the limit pin 85 does not prevent the vertical movement of the holding member 70.

The thread guide threading mechanism 18 will be described with reference to FIGS. 3 and 24 to 31. The thread guide threading mechanism 18 includes a horizontal plate-shaped base member 120 fixed to the lower portion of the head 4, a moving member 121 slidably mounted on the underside of the base member 120 and a pivot arm 122 pivotally mounted on the underside of the moving member 121.

The thread guide threading mechanism 18 further includes a thread hook member 123 pivotally mounted on the underside of the moving member 121 and having a thread hook 123*a* formed on the distal end thereof. The hook member 123 is coupled to the pivot arm 122 so as to be rockable between a standby position (see FIGS. 24 and 28) where the needle thread 11 drawn from the thread cassette 10 is not caught on the thread hook 123*a* and an operating position (see FIGS. 25 and 29) where the needle thread 11 can be caught on the thread hook 123*a*. The thread guide threading mechanism 18 further includes an operating force applying member 124 (see FIGS. 26 and 29) for applying to the hook member 123 an operating force for switching the hook member 123 between the stand by position and the operating position. The thread guide threading mechanism 18 further includes an operating force transmitting mechanism 125 for transmitting to the pivot arm 122 an operating force applied to the operating force applying member 124.

The thread guide threading mechanism 18 performs a first rocking switching the hook member 123 from a standby position to an operating position by an operating force the thread cassette 10 applies to the operating force applying member 124 in synchronization with attachment of the thread cassette. The thread guide threading mechanism 18 also performs a sliding movement in which the hook member 123 switched to the operating position and the pivot arm 122 are slid from the operating position together with the moving member 121 so that the first and second thread guides 19 and 20 are threaded. The thread guide threading mechanism 18 further performs a second rocking in which the hook member 123 is rocked to be returned to the standby position after the thread guides have been threaded.

The standby position includes a first standby position (see FIGS. 24 and 28) which is near the thread guides 19 and 20 before attachment of the thread cassette 10 and a second standby position (see FIGS. 27 and 31) which is farther from the thread guides 19 and 20 than the first standby position.

The base member 120 is suspended from two support members 131 and 132 (see FIG. 28) mounted on a frame member 130 constituting a part of the thread tensioning mechanism 14. The base member 120 has a stopper 133 integrally formed thereon so as to protrude downward. The stopper 133 receives the pivot arm 122 moving leftward during the sliding movement thereby to stop the arm.

The moving member 121 comprises a generally rectangular horizontal plate-shaped member and is mounted on two pin members 134 and 135 further mounted on the base member 120 so that the moving member is slid right and left. The moving member 121 is formed with a guide groove 121*a* extending in a right-and-left direction. The pin members 134 and 135 are engaged with each other so that the moving member 121 is slid relative to the base member 120. The guide groove 121*a* guides the sliding movement of the moving member 121. More specifically, the moving member 121 is mounted on the base member 120 so as to be slid by a predetermined distance between a first condition where the left pin member 134 is located at the left end of the guide groove 121*a* (see FIG. 24) and a second condition where the right pin 135 is located at the right end of the guide groove (see FIG. 27). The moving member 121 has a slit 121*b* formed in the rear of the guide groove 121*a* so as to be parallel to the guide groove. A return coil spring 136 is provided in the slit 121*b* to elastically urge the moving member 121 rightward (guide start end position in FIG. 24).

The pivot arm 122 has a proximal end which is pivotally mounted via a pin 137 (see FIG. 28) on the front right end of the moving member 121. A torsion spring 138 is provided around the pin 137 to elastically urge the pivot arm 122 counterclockwise in FIG. 24 (in the direction of standby position of the hook member 123). The pivot arm 122 has an operating force input portion 122*a* formed at a central right portion thereof. An operating force for switching the hook member 123 by the operating force transmitting mechanism 125 is supplied to the operating force input portion 122*a*. The pivot arm 122 has a distal end including a left-hand portion formed with a horizontally projecting abutment portion 122*b* which abuts against a stopper member 133 when the pivot arm 122 is slid by a predetermined distance together with the moving member 121 as will be described later.

Figure 24:
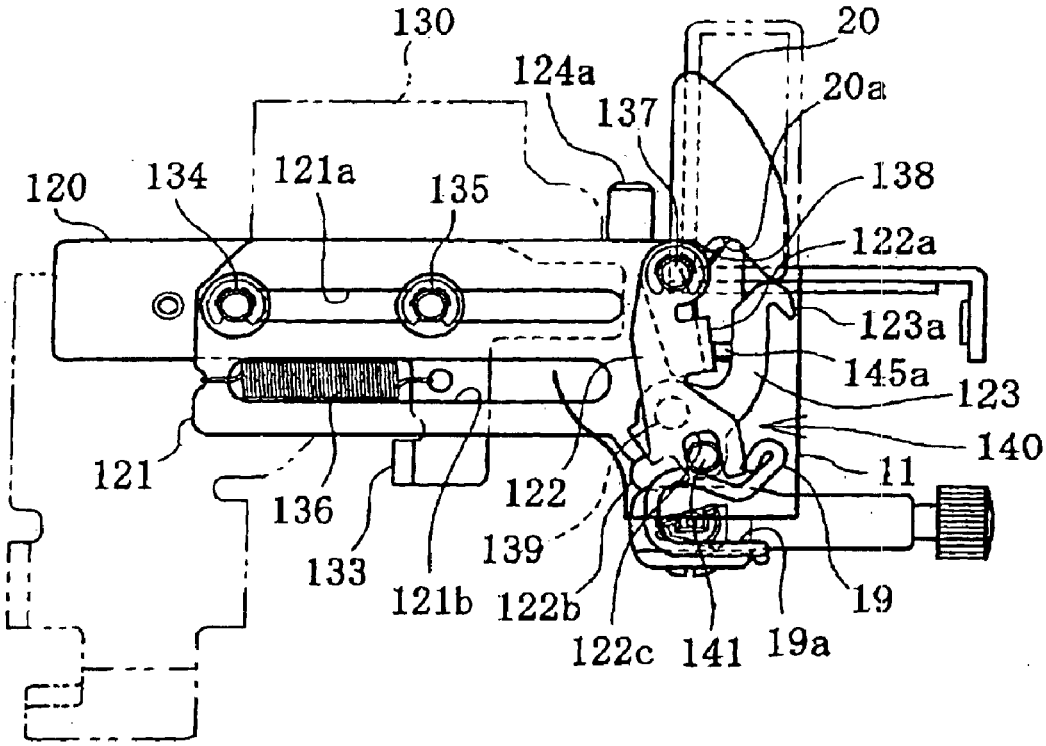
FIG. 24 is a bottom view of the threading mechanism under the condition immediately before the threading operation.
Figure 28:
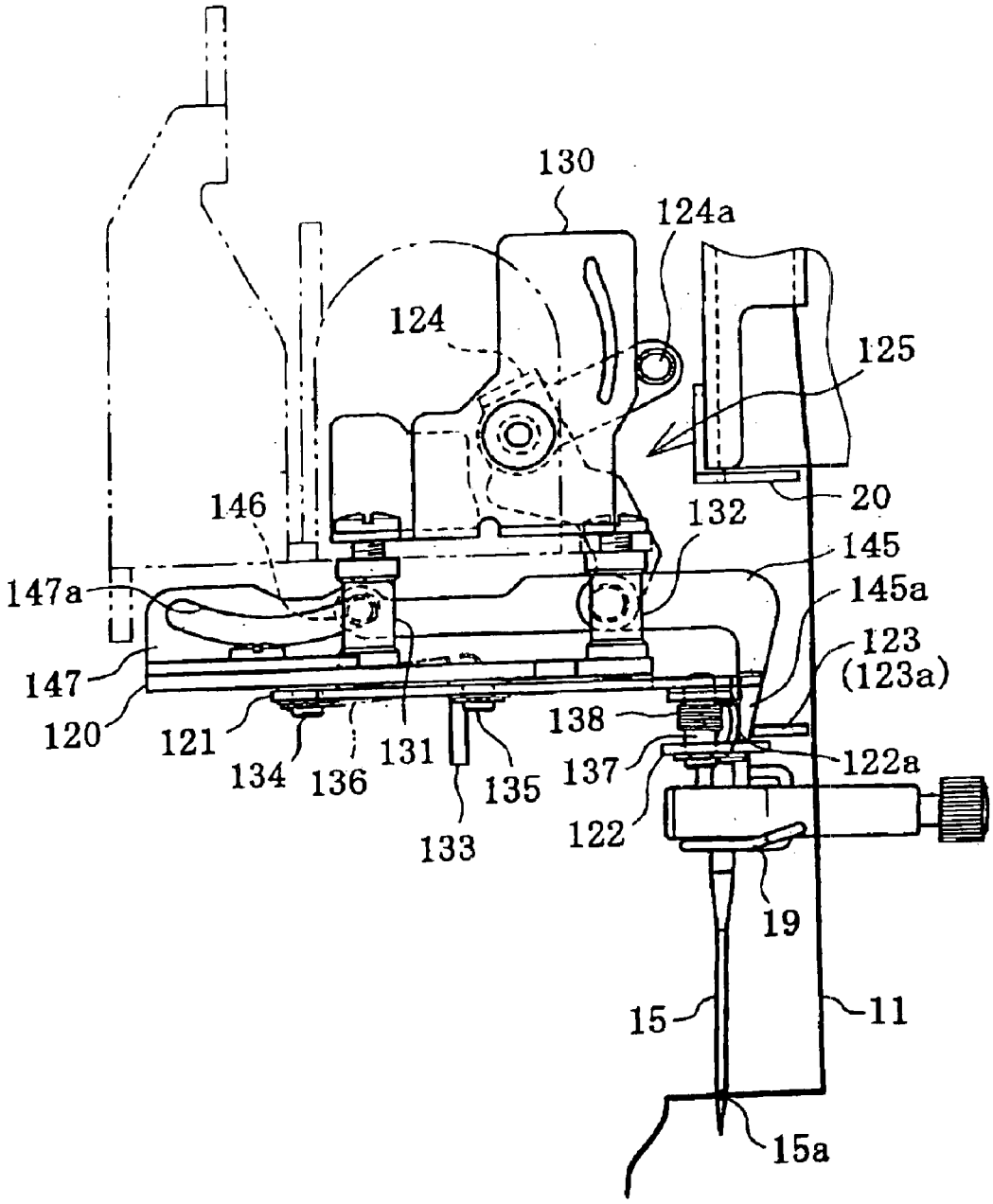
FIG. 28 is a front view of the threading mechanism under the condition as shown in FIG. 24.

The hook member 123 has a proximal end pivotally mounted via a pin 139 on the moving member 121. The distal end of the pivot arm 122 and a portion of the hook member 123 near the proximal end are interlocked by an interlock mechanism 140 which will be described later. Accordingly, the proximal ends of the hook member 123 and the pivot arm 122 are pivotally mounted on the moving member 121 so as to maintain a predetermined positional relation. The interlock mechanism 140 includes a notch 122*c* formed in the distal end of the pivot arm 122 and a pin 141 provided in the rear of the pin 139 near the proximal end of the hook member 123 so as to project downward and engage the notch 122*c*. The hook member 123 has a guide hook 123*a* which is away from the needle thread 11 when the hook member 123 is at the first standby position as shown in FIGS. 24 and 28. In this state, when the pivot arm 122 pivots clockwise in FIG. 25 about the pin 137 by a predetermined angle $\theta_1$ (for example, $\theta_1 \approx 20°$) against the urging force of the torsion spring 138, the notch 122*c* is also turned by the angle $\theta_1$. At this time, the pin 141 is turned about the pin 139 by the notch 122*c*.

Figure 25:
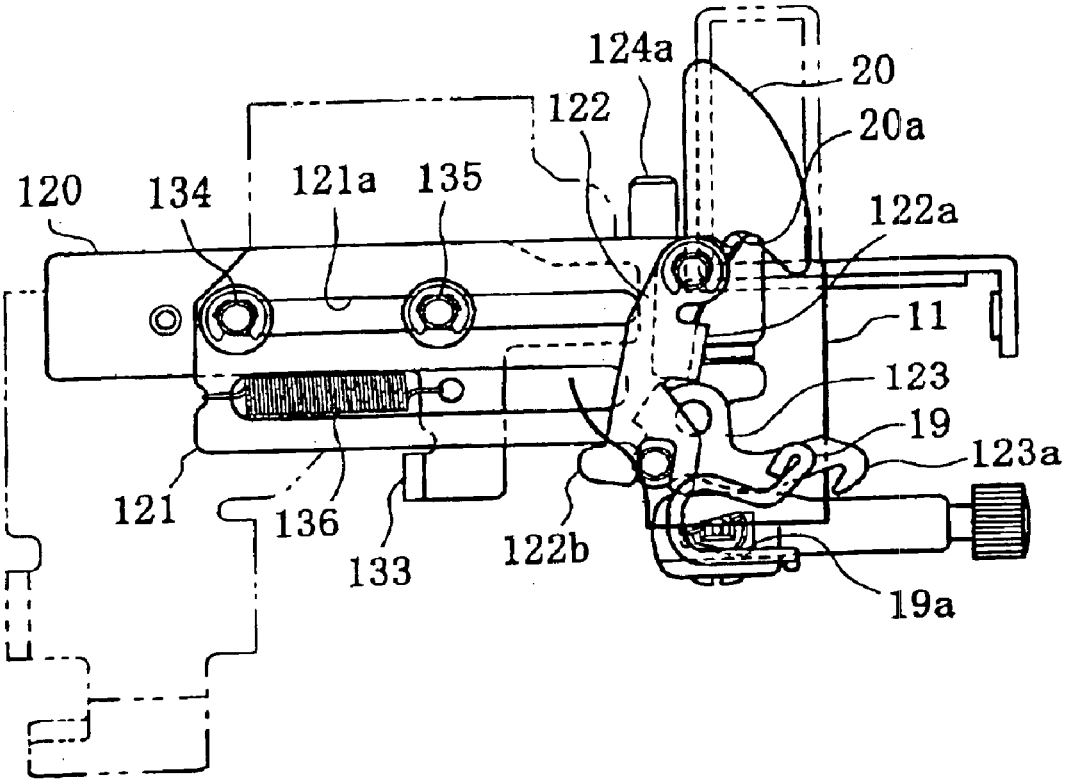
FIG. 25 is a bottom view of the threading mechanism under the condition after the first rocking motion.
Figure 29:
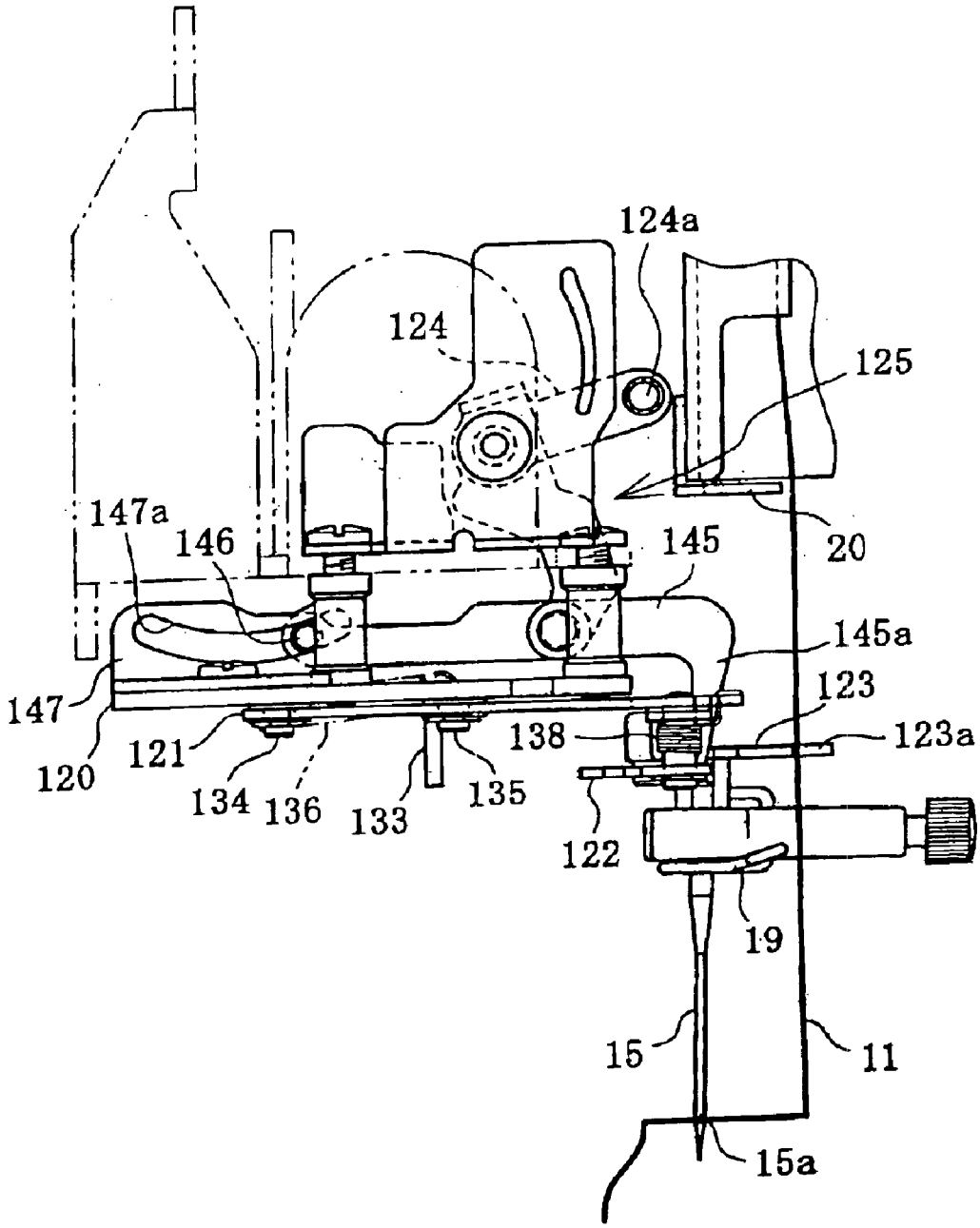
FIG. 29 is a front view of the threading mechanism under the condition as shown in FIG. 25.

The distance between the pins 137 and 141 is longer than the distance between the pins 139 and 141. Accordingly, when the hook member 123 is rocked in the horizontal state by the turning of the pin 141, the turning of the pin 141 is enlarged such that the guide hook 123*a* is rocked substantially horizontally clockwise in FIG. 25 about the pin 139 by a predetermined angle $\theta_2$ (for example, $\theta_2 \approx 90°$) which is larger than the pivot angle of the pivot arm 122. The hook member 123 reaches the operating position as shown in FIGS. 25 and 29, whereupon the guide hook 123*a* engages the needle thread 11. However, the hook member 123 is located below the pivot arm 122 and the moving member 121 and has an upwardly protruding portion (not shown) formed integrally therewith. The protruding portion is also turned with turn of the hook member 123. The moving member 121 partially overhangs a turning path of the protruding portion. When the hook member 123 pivots the predetermined angle $\theta_2$, the protruding portion of the hook member engages the overhang (not shown) of the moving member 121, whereupon a further pivot of the hook member 123 is prevented.

Referring to FIGS. 28 to 31, an operating force applying member 124 is pivotally mounted on a frame member 130 of the thread tensioning mechanism 14 so as to be rocked. The operating force applying member 124 has a forwardly projecting cassette contact 124*a* provided on the distal end side (right-hand end side) thereof. The lower end of the thread cassette 10 comes into contact with the cassette contact 124*a*. In attachment of the thread cassette 10, an operating force is transmitted from the thread cassette 10 to the cassette contact 124*a* in synchronization with attachment of the thread cassette so that the hook member 123 is switched between the standby position and the operating position. As a result, the operating force applying member 124 is rocked clockwise in FIG. 28.

An operating force transmitting mechanism 125 comprises a link member 145 pivotally mounted at its middle portion on the lower end of the operating force applying member 124, a distal end arm 145*a* formed on the distal end (right-hand end) of the link member 145 so as to be bent downward, a driven pin 146 provided on the proximal end (left-hand end) of the link member 145, and a cam plate 147 having an arc cam groove 147*a* the driven pin 146 engages. The link member 145 extends in the right-and-left direction and is moved in the right-and-left direction. When the operating force is applied from the thread cassette 10 to the cassette contact 124*a*, the operating force applying member 124 is rocked clockwise in FIG. 28. The link member 145 is moved leftward with the rocking of the operating force applying member 124. As described above, the moving member 121 is urged rightward by the coil spring 136. Since the pivot arm 122 is pivotally mounted on the moving member 121, the lower end of the distal end arm portion 140*a* is usually in abutment with the operating force input portion 122*a* of the pivot arm 122.

More specifically, the operating force is transmitted through the link member 145 extending in the right-and-left direction to the operating force input portion 122*a* of the pivot arm 122. Since the proximal end of the link member 145 is guided via the driven pin 146 along the cam groove 147*a* of the cam plate 147, the driven pin 146 is moved in an arc of the cam groove 147*a* substantially corresponding with an arc in which the lower end of the operating force applying member 124 is moved. Consequently, the overall link member 145 can smoothly be moved in the right-and-left direction. In other words, the link member 145 has no center of rotation when it is rotated. Accordingly, the distal end arm portion 145*a* presses the operating force input portion 122*a* substantially horizontally leftward, whereupon sliding friction can be prevented from occurring between the distal end arm 145*a* and the operating force input portion 122*a*.

A threading operation carried out by the thread guide threading mechanism 18 will now be described. Before attachment of the thread cassette, as shown in FIGS. 24 and 28, the hook member 123 is at the first standby position where the needle thread 11 is not caught on the threading hook 123*a*. In this state, when the thread cassette 10 is pushed into the cassette mount 5, the lower end of the cassette body 20 abuts against the cassette contact 124*a* such that the thread cassette applies an operating force to the cassette contact 124*a* thereby to rock the cassette contact clockwise in FIG. 28. At this time, when the operating force is transmitted from the operating force applying member 124 via the distal end arm portion 145*a* of the link member 145 to the operating force input portion of the pivot arm 122, a first rocking movement is carried out in which the pivot arm 122 is turned by the predetermined angle $\theta_1$ and the hook member 123 is switched from the standby position to the operating position.

More specifically, the operating force supplied to the operating force input portion 122*a* turns the pivot arm 122 about the pin 137 by the predetermined angle $\theta_1$ clockwise in FIG. 24. As a result, the hook member 123 is also rocked about the pin 139 clockwise in FIG. 24 between the first and second thread guides 19 and 20 by the interlock mechanism 140. The threading hook 123*a* is turned by the predetermined angle $\theta_2$ thereby to be switched to the operating position as shown in FIG. 25, engaging the needle thread 11. In order that the needle thread 11 may reliably be caught by the threading hook 123*a*, the operating position of the hook member 123 as shown in FIG. 25 is located rightward (opening direction of the thread guide portions 19*a* and 20*a*) relative to the first standby position as shown in FIG. 24. With turn of the pivot arm 122, the abutment portion 122*b* formed in the distal end of the pivot arm 122 projects leftward.

Figure 26:
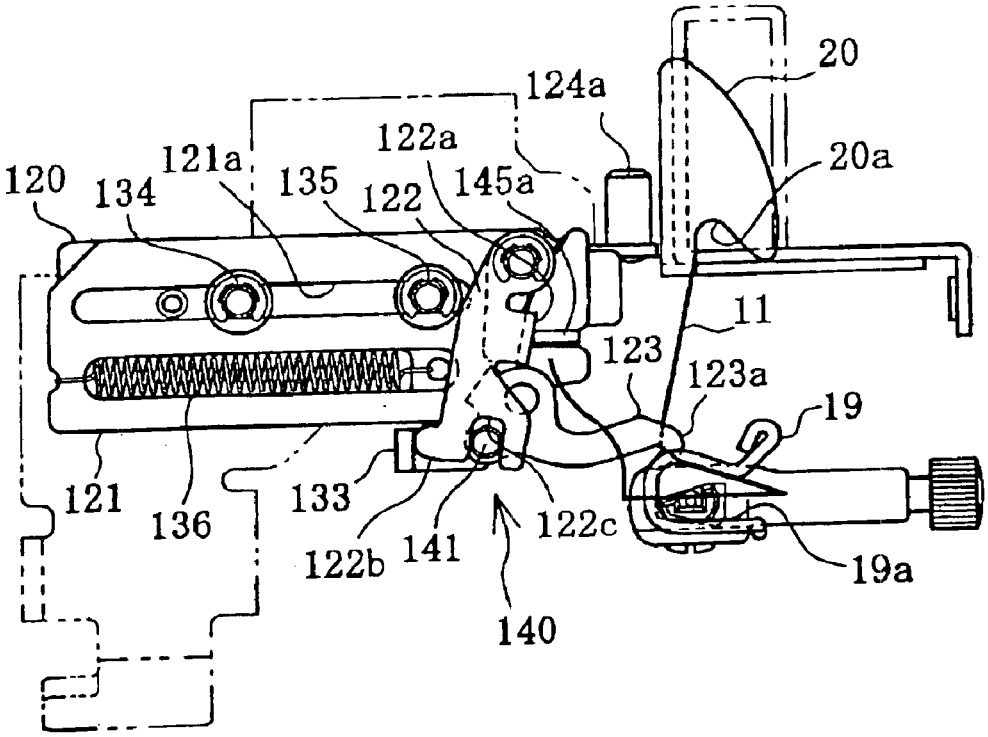
FIG. 26 is also a bottom view of the threading mechanism under the condition after the sliding motion.
Figure 30:
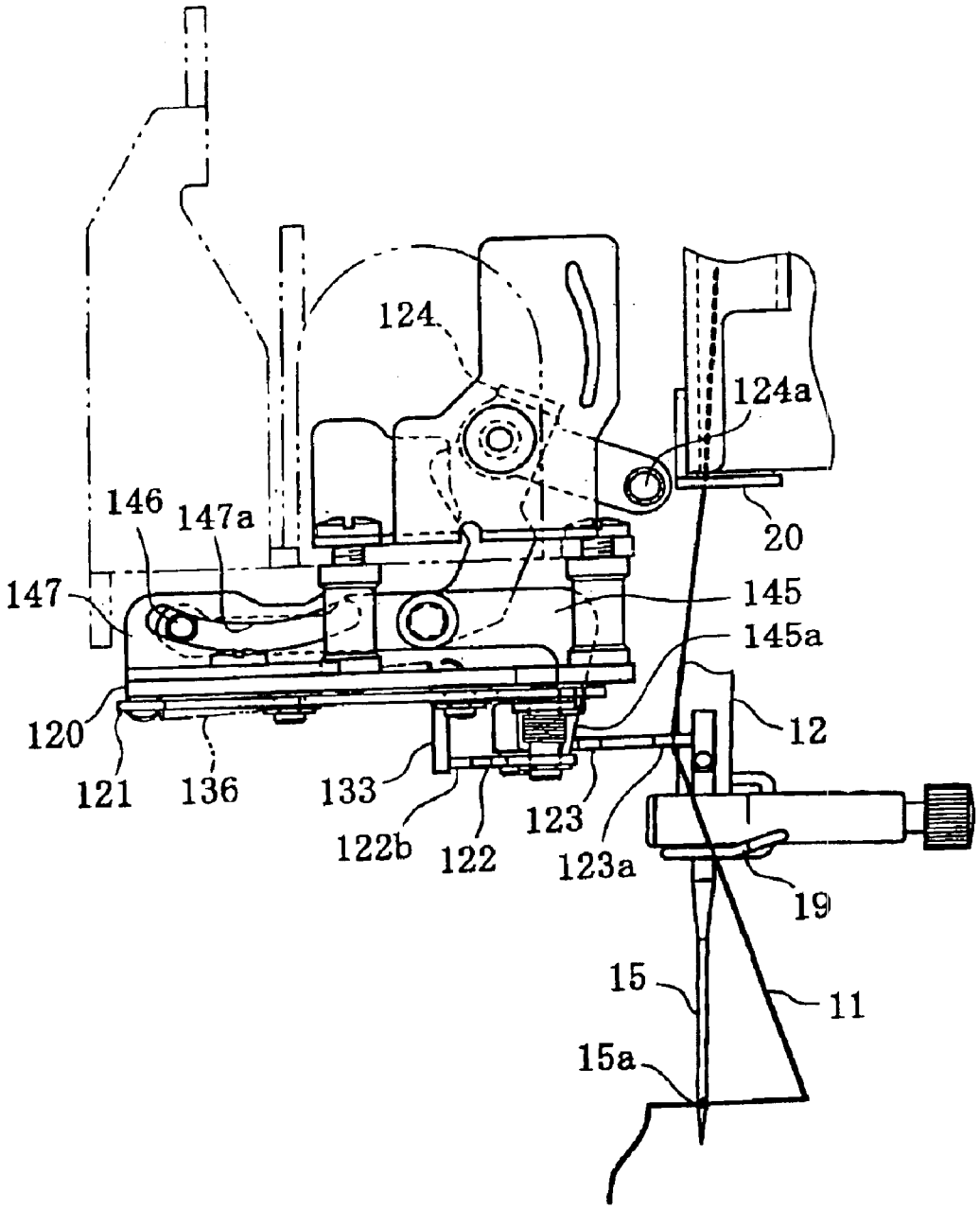
FIG. 30 is a front view of the threading mechanism under the condition as shown in FIG. 26.

When the operating force is further transmitted to the pivot arm 122 after the first rocking movement, further turn exceeding the predetermined angle $\theta_1$ is prevented by the engagement of the overhang of the moving member 121 and the projecting portion of the hook member 123. Accordingly, as shown in FIGS. 26 and 30, the hook member 123 switched to the operating position and the pivot arm 122 are slid leftward a predetermined distance together with the moving member 121 against the urging force of the coil spring 136 until the abutment portion 122*b* abuts against the stopper member 133. In the sliding movement, the needle thread 11 engaging the threading hook 123*a* is drawn leftward together with the hook member 123 such that the needle thread is caught on the threading portions 19*a* and 20*a* of the first and second thread guides 19 and 20 respectively.

The threading portions 19*a* and 20*a* of the respective thread guides 19 and 20 are open substantially rightward as shown in FIGS. 24 to 27. The hook member 123 is moved between the standby position and the operating position which are further between the two thread guides 19 and 20. Accordingly, the needle thread 11 engaging the threading hook 123*a* is reliably caught on the thread guides 19 and 20 by the sliding movement. Furthermore, the needle thread 11 engaging the threading hook 123*a* is moved from the open ends (right ends) of the threading portions 19*a* and 20*a* of the thread guides 19 and 20 to the inner ends (left ends), whereupon the needle thread 11 is reliably caught on the inner ends of thread guides 19 and 20.

Referring to FIGS. 26 and 30, when the abutment 122*b* abuts against the stopper member 133, the pin 141 is unable to move leftward (a part of the pivot arm 122 is temporarily stopped relative to the moving member 121). In this state, when the thread cassette 10 is further thrust into the cassette mount such that an operating force is further supplied to the input portion 122*a*, the second rocking movement is carried out to return the hook member 123 to the standby position. More specifically, the moving member 121 is moved leftward relative to the base member 120 until the right-hand pin 135 engages the right end of the guide groove 121*a*. Accordingly, the pivot arm 122 is caused to pivot about the pin 141 counterclockwise in FIG. 27. The interlock mechanism 140 is operated by the pivot of the arm 122 so that the hook member 123 is rocked about the pin 141 counterclockwise in FIG. 27 thereby to be switched to the second standby position.

The abutment 122*b* is slid on the stopper member 133 with pivot of the arm 122. On this occasion, the needle thread 11 is disengaged from the threading hook 123*a* to be detached from the hook, whereupon catching the needle thread 11 on the thread guides 19 and 20 is completed. When the hook member 123 is switched to the second standby position, the threading hook 123*a* is located farther away from the needle bar 12 and needle thread 11 than when the hook member 123 is at the first standby position.

The sequential operation of the sewing machine M in the attachment of the thread cassette 10 will now be described with main concern to the threading operation of the threading mechanism 16, thread holding operation of the thread holding mechanism 17 and thread guiding operation of the thread guide mechanism 18. When the thread cassette 10 is inserted into the cassette mount 5 from above, the lower end of the cassette body 30 thrusts the cassette contact 90 downward as shown in FIGS. 14 to 19. As a result, the interlock mechanism 73 is operated so that the holding member 70 is moved downward in synchronization with attachment of the thread cassette 10. When reaching the pin passage 112 inside the cam member 42 of the thread cassette 10, the driven pin 84 provided on the thread holding member 74 is moved downward along the cam face 111*a*. Consequently, the driven pin 84 is operated by the cam member 42 so that the thread holding member 74 is rocked about the pivot shaft 82 to the releasing side against the urging force of the torsion spring 75.

The thread nipping member 74 is rocked to the maximum releasing side when the holding member 70 is moved downward such that the driven pin 84 abuts against the rearmost projecting portion of the cam face 111*a* as shown in FIG. 17. At this time, the portion 11*c* (FIGS. 4 and 7) of the needle thread 11 extending along the front of the thread cassette 10 enters the space between the left thread holding portion 71 and the thread nipping member 74. Thereafter, when the driven pin 84 is moved downward along the cam face 111*a*, the thread nipping member 74 is rocked to the holding side by the torsion spring 75. When the driven pin 84 gets out of the pin passage 112 to be completely detached from the cam face 111*a*, the needle thread 11 is held between the holding member 71 and the thread nipping member 74 as shown in FIG. 18. In this state, the moving frame 77 and the holding member 70 are further moved downward with attachment of the thread cassette 10, so that the needle thread 11 is held near the needle eye 15*a* by the paired thread holding portions 71 and 72 of the holding member 70.

The threading operation is also carried out by the threading mechanism 16 synchronously. More specifically, the threading shaft 50, slider guide 51 and threading slider 52 are moved downward in synchronization with attachment of the thread cassette 10, as shown in FIG. 8. When moved downward a predetermined distance, the threading shaft 50 is prevented from further downward movement by the pin member 56 and limiting member 12*c*. However, the threading slider 52 is further moved downward against the urging force of the coil spring 58. Thus, the threading slider 52 is further moved downward relative to the threading shaft 50. The relative movement of the threading slider 52 is converted to turn of the threading shaft 50 by the pin member 56*a* and cam groove 52*a* of the threading slider 52, whereby the threading shaft 50 is turned by a predetermined angle.

The hook mechanism 53 provided on the lower end of the threading shaft 50 is also turned with the threading shaft as shown in FIG. 20. As a result, the hook portion 60*a* of the threading hook 60 is passed through the needle eye 15*a*. At this time, the holding member 70 of the thread holding mechanism 17 starts to move upward from the lowermost position, so that the needle thread 11 held by the thread holding portions 71 and 72 is caught by the hook 60*a*. At this time, the cam portion 54*b* of the threading shaft driving member 54 abuts against the distal end cam portion 69*a* of the cam member 69 so that the threading shaft driving member 54 is driven counterclockwise in FIG. 8 against the urging force of the torsion spring 67. Accordingly, since the drive force for driving the shaft 50 downward is not transmitted to the threading slider 52, the shaft 50 is turned in the opposite direction and returned upward by the urging force of the coil spring 58. With this, the hook mechanism 53 is turned together with the shaft 50, whereupon the hook member 123 on which the needle thread 11 is caught is returned through the needle eye 15*a* as shown in FIG. 21. Thus, the threading operation is completed.

Thus, when the thread cassette 10 is further pushed into the cassette mount 5 with the needle thread 11 having been passed through the needle eye 15*a*, the needle thread is caught on the two thread guides 19 and 20 by the threading mechanism 18. More specifically, as shown in FIGS. 24 and 28, the lower end of the cassette body 30 abuts against the cassette contact 124*a* of the operating force applying member 124 when the thread cassette 10 is thrust into the cassette mount 5 under the condition where the hook member 123 is at the first standby position where the needle thread 11 is not caught on the threading hook 123*a*. Consequently, the operating force from the thread cassette 10 is applied to the cassette contact 124*a*.

Figure 27:
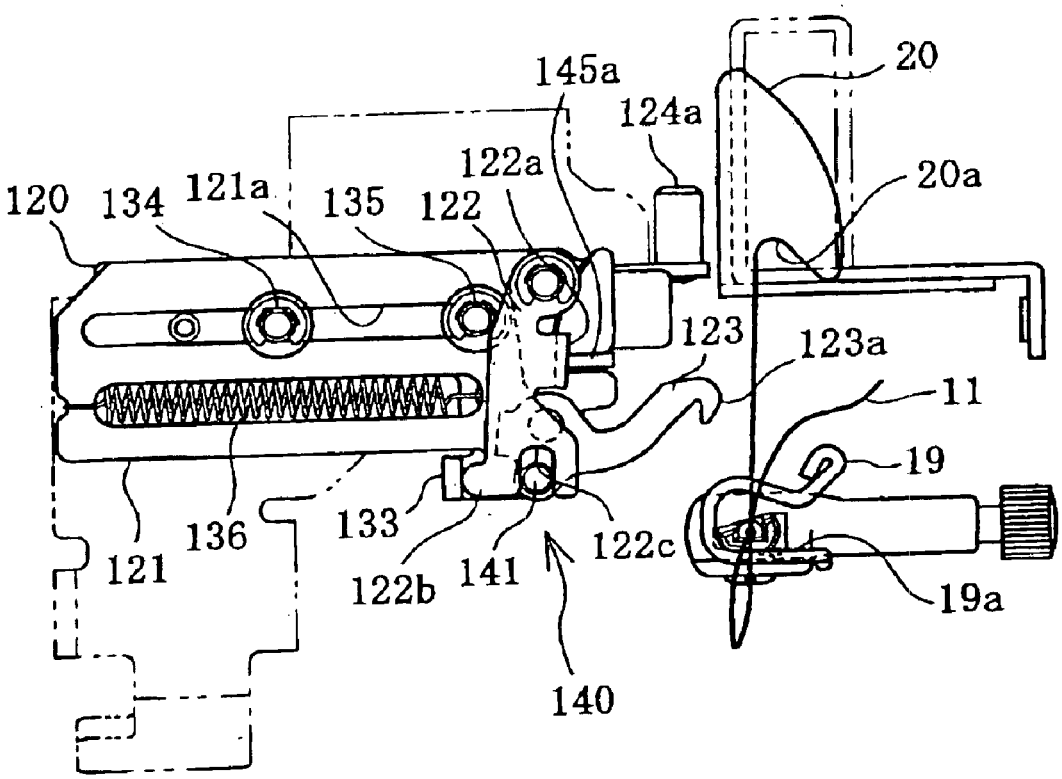
FIG. 27 is a bottom view of the threading mechanism under the condition after the second rocking motion.
Figure 31:
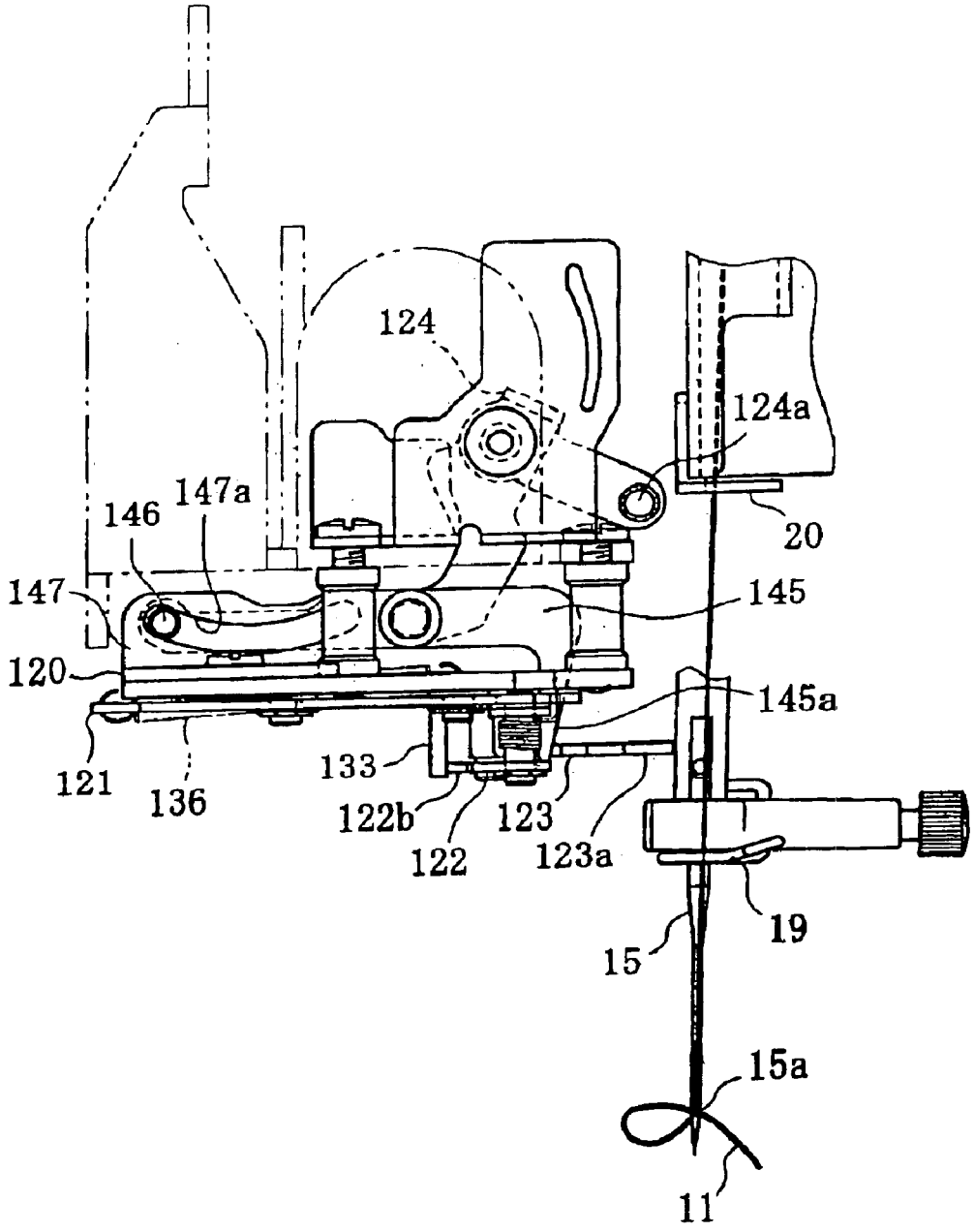
FIG. 31 is a front view of the threading mechanism under the condition as shown in FIG. 27.

The operating force applied to the operating force applying member 124 is transmitted to the input portion 122*a* of the pivot arm 122 by the operating force transmitting mechanism 125. Then, the first rocking movement is carried out in which the hook member 123 is switched from the first standby position to the second standby position so that the needle thread 11 engages the threading hook 123*a*, as shown in FIGS. 25 and 29. The sliding movement is then carried out in which the hook member 123 switched to the operating position and the pivot arm 122 are slid together with the moving member 121, as shown in FIGS. 26 and 30, whereupon the needle thread 11 is caught by the thread catching portions 19*a* and 20*a* of the thread guides 19 and 20. Furthermore, the second rocking movement is carried out in which the hook member 123 is returned to the second standby position after the needle thread has been caught by the thread guides 19 and 20, as shown in FIGS. 27 and 31. Consequently, the needle thread 11 is disengaged from the threading hook 123*a* and the threading operation is completed.

The following effects can be achieved from the above-described sewing machine M. In the thread holding mechanism 17, the thread holding member 70 including the paired thread holding portions 71 and 72 is moved near the needle eye 15*a* by the sequential transferring mechanism 73 in synchronization with attachment of the thread cassette 10. More specifically, when the thread cassette 10 transmits an operating force to the cassette contact 90, the operating force is transmitted to the sequential transferring mechanism 73 so that the moving frame 77 is moved together with the holding member 70. In the movement, the thread nipping member 74 releasably nipping the needle thread 11 at the thread holding portion 71 is switched temporarily to the releasing side by the cam member 42 mounted on the thread cassette 10. As a result, the needle thread 11 is interposed between the thread nipping portion 71 and the thread nipping member and the holding member 70 is then transferred by the sequential transferring mechanism 73. Consequently, since the needle thread 11 is reliably held near the needle eye 15*a*, the needle thread can smoothly be passed through the needle eye 15*a* by the threading mechanism 16.

Furthermore, the thread holding operation by the thread holding mechanism 17 is automatically carried out by attachment of the thread cassette 10 as in the threading mechanism 16. Accordingly, the needle thread 11 can be passed through the needle eye 15*a* just by attaching the thread cassette 10 to the cassette mount 5. Consequently, since drawing the needle thread 11 from the thread cassette 10 is eliminated, the preparation for sewing can efficiently be carried out.

The driven pin 84 and the limit pin 85 are opposed to each other with the support shaft 82 located therebetween. The limit pin 85 departs from the recess 71*a* of the thread holding portion 71 and the recess 74*a* of the thread nipping member 74. Accordingly, the needle thread 11 can be prevented from entangling with the limit pin 85 while interposed between the thread holding portion 71 and the thread nipping member 74. Furthermore, since the driven pin 84 and the limit pin 85 protrude in the directions opposed to each other, the limit pin can be prevented from interference (collision) with the cam member 42.

The driven pin 84 can easily be brought into contact with the cam face 111*a* since the cam member 42 projects from the surface of the thread cassette 10. Furthermore, the cam face 111*a* fronts on the surface of the thread cassette 10. In other words, since the cam face 111*a* is formed on the inside of the cam member 42 projecting from the surface of the thread cassette 10, the driven pin 84 is not exposed while in contact with the cam face 111*a*, whereupon the pin is free from interference with other components. Consequently, the driven pin 84 can be operated reliably by the cam member 42.

Several modified forms will be described. The supply of thread accommodated in the thread cassette 10 includes a thread spool and bobbin in the foregoing embodiment. However, various types of thread supply may be used. For example, a mere mass of thread may be used. Furthermore, the thread cassette may be constructed so that the thread spool or mass of thread is exposed and mounted on the spool pin.

In the foregoing embodiment, the user thrusts the thread cassette into the cassette mount 5 with his or her hand or hands. Other driving means such as rubber rollers or an electric motor maybe used so that the thread cassette 10 is automatically attached to the cassette mount 5. The aforesaid drive means may be used to drive the thread holding mechanism 17 and the thread guide mechanism 18. Furthermore, other driving means or the user may apply an external operating force to the cassette contact 90 serving as the operating force transmitting member of the thread holding mechanism 17, instead of the thread cassette 10.

The urging member urging the thread nipping member 74 toward the thread interposition side may be a magnet, link mechanism, cam or the like, instead of the torsion spring 75.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A thread holding mechanism holding a thread when the thread is passed through an eye of a sewing needle, the mechanism comprising:

a thread holding member including a thread holding portion capable of holding the thread;

an operating force transmitting member to which an external force is applied;

a moving member to which the operating force transmitting member transmits the force, moving the thread holding member near the eye of the needle;

a thread nipping member provided in the thread holding member for releasably nipping the thread; and a switching member provided near a movement path of the thread holding member for switching the thread nipping member to an interposition releasing side temporarily prior to thread holding in synchronization with a predetermined stage of a step of moving the thread nipping member.

2. A sewing machine comprising:

a thread cassette accommodating a supply of thread and detachably attached to a cassette mount;

a threading mechanism passing the thread drawn from the thread supply out of the thread cassette through an eye of a needle in synchronization with attachment of the thread cassette to the cassette mount;

a thread holding mechanism for holding the thread near the needle eye in order that the thread may be passed through the needle eye, the thread holding mechanism including:

a thread nipping g member including a thread nipping portion capable of nipping the thread;

an operating force transmitting member to which an external force is applied;

a moving member to which the operating force transmitting member transmits the force, moving the thread holding member near the eye of the needle; and a thread nipping member provided in the thread holding member for releasably nipping the thread;

a switching member provided near a movement path of the thread holding member for switching the thread nipping member to an interposition releasing side temporarily prior to thread holding in synchronization with a predetermined stage of a step of moving the thread holding member.

3. A sewing machine according to claim 2, wherein the thread nipping member is pivotally mounted on a support shaft further mounted on the holding member and includes a driven pin operated by the switching member and a limiting pin provided at a side opposed to the driven pin with respect to the support shaft for limiting the thread nipping member rocking to a thread nipping side over a predetermined range.

4. A sewing machine according to claim 3, wherein the driven pin and the limiting pin protrude in respective directions opposed to each other.

5. A sewing machine according to claim 3, wherein the thread holding mechanism includes an urging member elastically urging the thread nipping member to a thread nipping side, and the switching member includes a cam member for rocking the thread nipping member.

6. A sewing machine according to claim 5, wherein the cam member protrudes from a surface of the thread cassette and has a cam face fronting on the surface of the thread cassette, the driven pin being moved along the cam face in attachment of the thread cassette to the cassette mount.

* * * * *